US011302256B2

(12) United States Patent
Kwon et al.

(10) Patent No.: US 11,302,256 B2
(45) Date of Patent: Apr. 12, 2022

(54) ELECTROLUMINESCENT DISPLAY DEVICE AND DRIVING METHOD THEREOF

(71) Applicant: LG Display Co., Ltd., Seoul (KR)

(72) Inventors: Yong-Chul Kwon, Seoul (KR); Sung-Hoon Kim, Paju-si (KR)

(73) Assignee: LG DISPLAY CO., LTD., Seoul (KR)

( * ) Notice: Subject to any disclaimer, the term of this patent is extended or adjusted under 35 U.S.C. 154(b) by 0 days.

(21) Appl. No.: 17/130,362

(22) Filed: Dec. 22, 2020

(65) Prior Publication Data

US 2021/0193047 A1 Jun. 24, 2021

(30) Foreign Application Priority Data

Dec. 23, 2019 (KR) ..... 10-2019-0173127

(51) Int. Cl.
*G09G 3/3258* (2016.01)
*G09G 3/3275* (2016.01)
*G09G 3/3233* (2016.01)

(52) U.S. Cl.
CPC ..... *G09G 3/3258* (2013.01); *G09G 3/3275* (2013.01); *G09G 3/3233* (2013.01); *G09G 2310/08* (2013.01); *G09G 2320/064* (2013.01); *G09G 2320/0646* (2013.01); *G09G 2330/021* (2013.01); *G09G 2360/16* (2013.01)

(58) Field of Classification Search
CPC .. G09G 3/3258; G09G 3/3275; G09G 3/3233; G09G 2310/08; G09G 2320/064; G09G 2320/0646; G09G 2330/021; G09G 2360/16
USPC ..... 345/691
See application file for complete search history.

(56) References Cited

U.S. PATENT DOCUMENTS

2014/0104305 A1* 4/2014 Ryu ..... G09G 3/32 345/589
2014/0340379 A1* 11/2014 Kim ..... G09G 3/3225 345/212
2015/0123955 A1* 5/2015 Bi ..... G09G 3/3275 345/207

(Continued)

FOREIGN PATENT DOCUMENTS

KR 10-2015-0041485 A 4/2015
KR 10-2016-0047083 A 5/2016

*Primary Examiner* — Tom V Sheng
(74) *Attorney, Agent, or Firm* — Polsinelli PC

(57) ABSTRACT

An electroluminescence display device lowers peak brightness of a screen image based on a preset peak luminance control (PLC) curve as an average picture level (APL) of the image is increased. The electroluminescence display device includes a memory and a timing controller. The memory stores an ELVDD reference profile for defining EVDD adjusting levels for adjusting a high-potential pixel voltage applied to pixels of the screen image in units of 1 image frame and an MDATA reference profile for defining Max data adjusting values for adjusting image data applied to the pixels of the screen image in the units of 1 image frame, for matching target peak brightness for each preset APL section with the PLC curve. The timing controller calculates an EVDD adjusting value and a Max data adjusting value of a first image frame based on an analysis result of image data of the first image frame and information stored in the memory and modulates image data of the first image frame based on the Max data adjusting value.

25 Claims, 25 Drawing Sheets

(A) BRIGHTNESS FOR EACH ELVDD (B) TARGET PEAK BRIGHTNESS FOR EACH APL (PLC CURVE)

(C) DISCRETE ELVDD FOR EACH APL (ELVDD REFERENCE PROFILE)

(56) References Cited

U.S. PATENT DOCUMENTS

| | | | | |
|---|---|---|---|---|
| 2015/0170560 | A1* | 6/2015 | Lim | G09G 3/3291<br>345/691 |
| 2016/0275865 | A1* | 9/2016 | Bi | G09G 3/3275 |
| 2016/0314760 | A1* | 10/2016 | Jangda | G09G 3/3208 |
| 2018/0182288 | A1* | 6/2018 | Kim | G09G 3/2059 |

* cited by examiner (A) BRIGHTNESS FOR EACH ELVDD (B) TARGET PEAK BRIGHTNESS FOR EACH APL (PLC CURVE)

(C) DISCRETE ELVDD FOR EACH APL
(ELVDD REFERENCE PROFILE)

(A) DISCRETE ELVDD FOR EACH APL (B) TARGET PEAK BRIGHTNESS FOR EACH APL (C) MAX DATA PROFILE FOR EACH APL
(MDATA REFERENCE PROFILE)

ELECTROLUMINESCENT DISPLAY DEVICE AND DRIVING METHOD THEREOF

CROSS-REFERENCE TO RELATED APPLICATION

This application claims the benefit of Korean Patent Application No. 10-2019-0173127, filed on Dec. 23, 2019, which is hereby incorporated by reference in its entirety.

BACKGROUND

Field of the Disclosure

The present disclosure relates to an electroluminescence display device and a driving method thereof.

Description of the Background

Peak luminance control (PLC) driving technologies have been known in order to reduce consumption power in an electroluminescence display device. According to the PLC driving technologies, as an average picture level (hereinafter, 'APL') of one image based on a preset PLC curve is increased, peak brightness of the image is lowered, thereby reducing consumption power. Target peak brightness appropriate for each APL is determined according to a PLC curve, and in this regard, as an APL is increased, target peak brightness corresponding thereto may be lowered, and in contrast, as an APL is lowered, target peak brightness corresponding thereto may be increased.

However, according to the conventional PLC driving technologies, in order to match the target peak brightness for each APL with a PLC curve, only maximum (Max) data of each image is gradually adjusted based on the PCL curve while a high-potential pixel voltage is fixed or only a high-potential pixel voltage is gradually adjusted based on the PLC curve while Max data of each image is fixed. Here, the high-potential pixel voltage may be a power voltage that is commonly applied to each pixel, and the Max data may be the brightest image data among a plurality of representative image data included in each image. The conventional PLC driving technologies have a limit in reducing consumption power and have a difficulty in setting target peak brightness for each APL according to the PLC curve.

SUMMARY

Accordingly, the present disclosure provides an electroluminescence display device and a driving method thereof for effectively reducing consumption power and easily setting target peak brightness for each APL depending on a PLC curve when PLC driving technology is applied.

To achieve these and other advantages and in accordance with the purpose of the disclosure, as embodied and broadly described herein, an electroluminescence display device according to an aspect of the present disclosure lowers peak brightness of a screen image based on a preset peak luminance control (PLC) curve as an average picture level (APL) of the image is increased. The electroluminescence display device includes a memory and a timing controller.

The memory stores an ELVDD reference profile for defining EVDD adjusting levels for adjusting a high-potential pixel voltage applied to pixels of the screen image in units of 1 image frame and an MDATA reference profile for defining Max data adjusting values for adjusting image data applied to the pixels of the screen image in the units of 1 image frame, for matching target peak brightness for each preset APL section with the PLC curve.

The timing controller calculates an EVDD adjusting value and a Max data adjusting value of a first image frame based on an analysis result of image data of the first image frame and information stored in the memory and modulates image data of the first image frame based on the Max data adjusting value. Here, wherein the EVDD adjusting levels are independently defined for the each APL section, and wherein the Max data adjusting values are independently defined for the each APL section.

BRIEF DESCRIPTION OF THE DRAWINGS

The accompanying drawings, which are included to provide a further understanding of the disclosure and are incorporated in and constitute a part of this application, illustrate aspect(s) of the disclosure and together with the description serve to explain the principle of the disclosure.

In the drawings.

DETAILED DESCRIPTION OF THE DISCLOSURE

Figure 1:
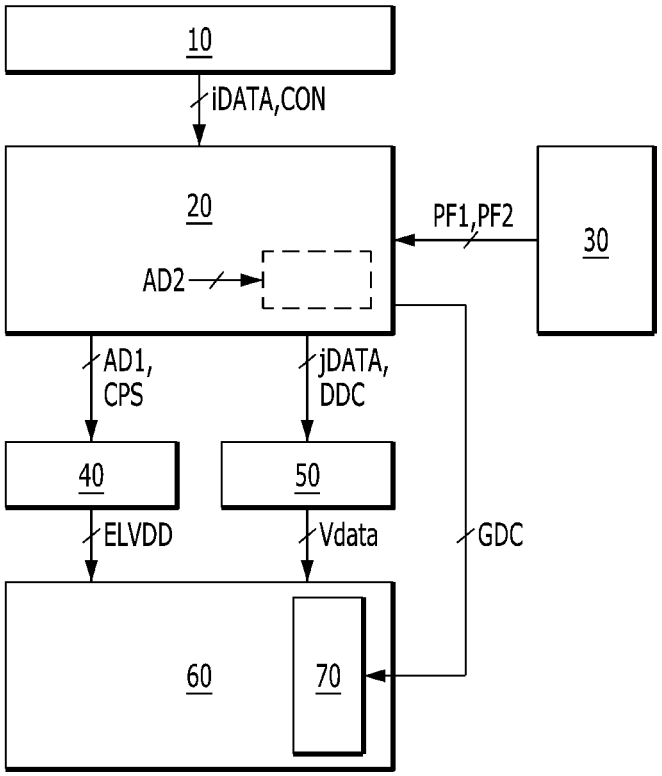
FIGS. 1 and 2 are diagrams showing an electroluminescence display device according to an aspect of the present disclosure.

Hereinafter, the present disclosure will be described more fully with reference to the accompanying drawings, in which exemplary aspects of the disclosure are shown. The disclosure may, however, be embodied in many different forms and should not be construed as being limited to the aspects set forth herein; rather, these aspects are provided so that this disclosure will be thorough and complete, and will fully convey the concept of the disclosure to those skilled in the art.

The shapes, sizes, ratios, angles, numbers and the like disclosed in the drawings for description of various aspects of the present disclosure to describe aspects of the present disclosure are merely exemplary and the present disclosure is not limited thereto. Like reference numerals refer to like elements throughout. Throughout this specification, the same elements are denoted by the same reference numerals. As used herein, the terms "comprise", "having," "including" and the like suggest that other parts can be added unless the term "only" is used. As used herein, the singular forms "a", "an", and "the" are intended to include the plural forms as well, unless context clearly indicates otherwise.

Elements in various aspects of the present disclosure are to be interpreted as including margins of error even without explicit statements.

With regard to the following description of the present disclosure, in describing positional relationships, phrases such as "an element A on an element B," "an element A above an element B," "an element A below an element B" and "an element A next to an element B," another element C may be disposed between the elements A and B unless the term "immediately" or "directly" is explicitly used.

With regard to the following description of the present disclosure, in describing elements, terms such as "first" and "second" are used, but the elements are not limited by these terms. These terms are simply used to distinguish one element from another. Accordingly, as used herein, a first element may be a second element within the technical idea of the present disclosure.

In the following description of the present disclosure, a detailed description of known functions and configurations incorporated herein will be omitted when it may make the subject matter of the present disclosure unclear Hereinafter, an aspect of the present disclosure will be described in detail with reference to the accompanying drawings.

Figure 2:
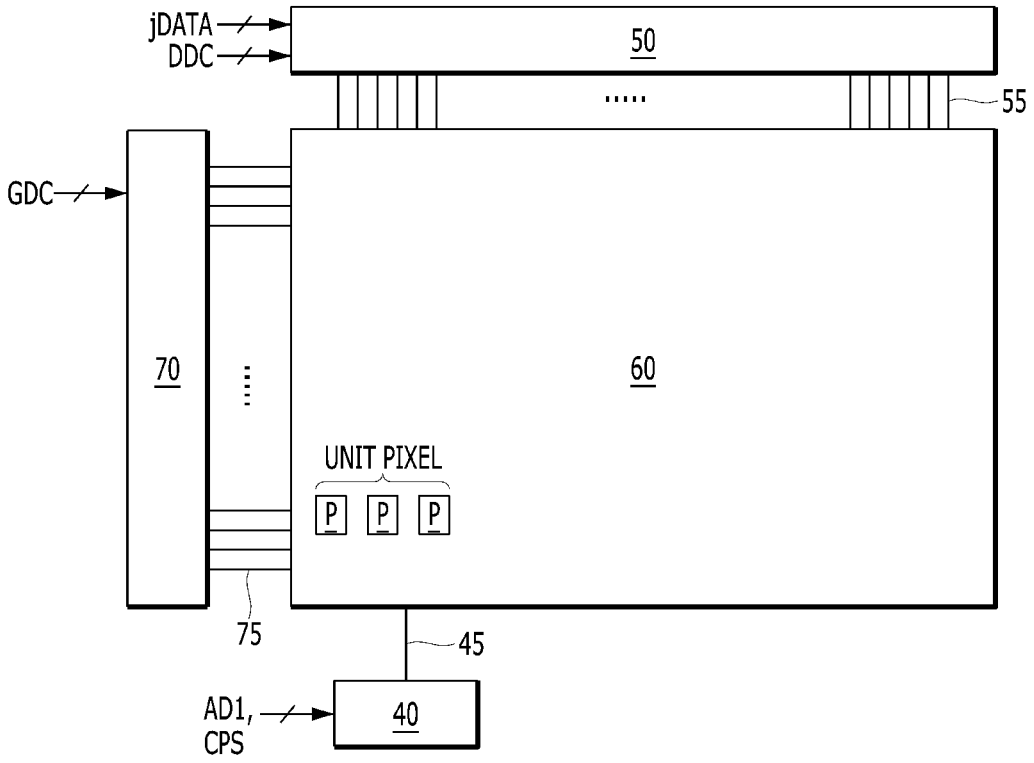
Figure 3:
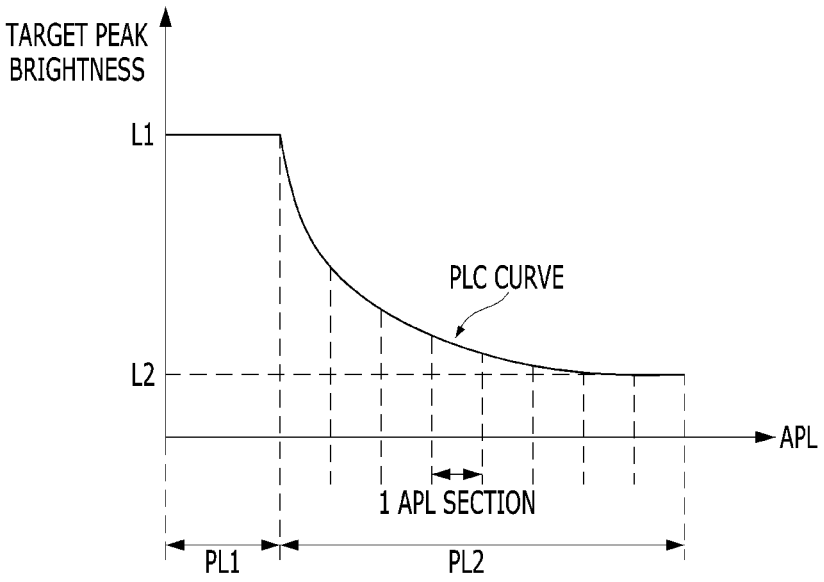
FIG. 3 is an equivalent circuit diagram of one pixel included in a display panel of FIGS. 1 and 2.
Figure 4:
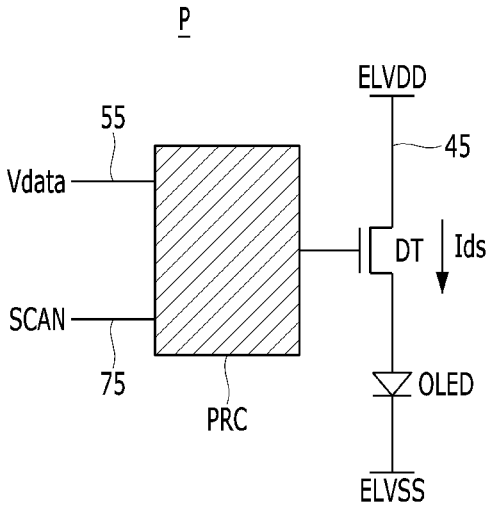
FIG. 4 is a diagram showing a peak luminance control (PLC) curve for PLC driving.
Figure 5:
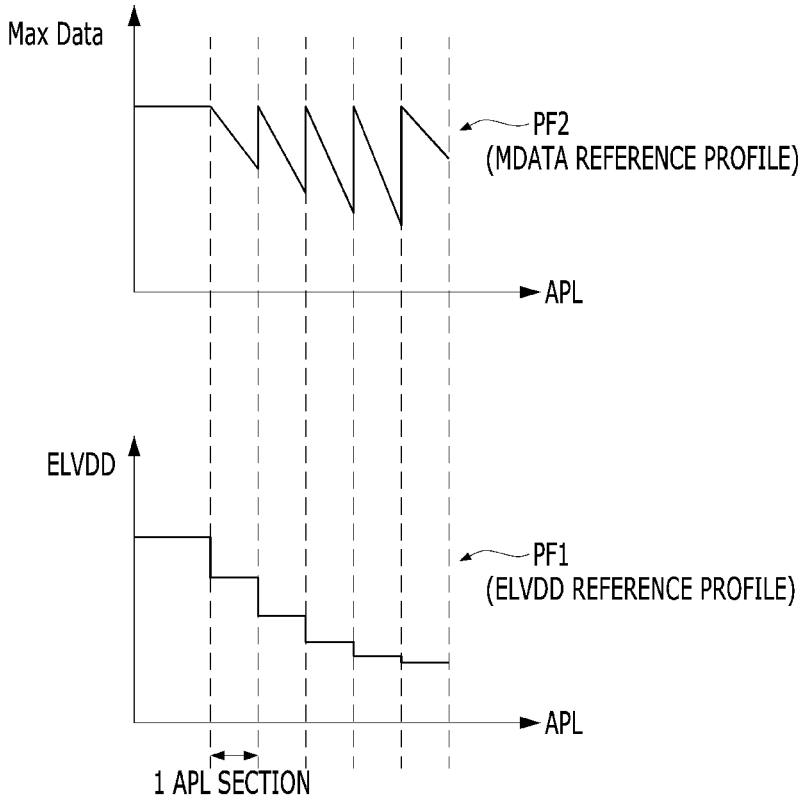
FIG. 5 is a diagram showing a MDATA reference profile and an EVDD reference profile that are pre-stored in a memory in order to embody a PLC driving technology according to an aspect of the present disclosure.

FIGS. 1 and 2 are diagrams showing an electroluminescence display device according to an aspect of the present disclosure. FIG. 3 is an equivalent circuit diagram of one pixel included in a display panel of FIGS. 1 and 2. FIG. 4 is a diagram showing a peak luminance control (PLC) curve for PLC driving. FIG. 5 is a diagram showing a MDATA reference profile and an EVDD reference profile that are pre-stored in a memory in order to embody a PLC driving technology according to an aspect of the present disclosure.

Referring to FIGS. 1 and 2, the electroluminescence display device according to an aspect of the present disclosure may include a host system 10, a timing controller 20, a memory 30, a power voltage output circuit 40, a data driver 50, a display panel 60, and a gate driver 70.

Referring to FIG. 1, the host system 10 may be embodied as various systems such as a television system, a set-top box, a navigation system, a DVD player, a Blu-ray player, a personal computer, a home theater system, or a phone system. The host system 10 may include a system on chip (SoC) including a scaler installed therein and may convert input image data iDATA into a format appropriate for resolution of the display panel 60. The host system 10 may transmit a timing control signal CON with the input image data iDATA to a timing controller 20. The timing control signal CON may include a vertical synchronization signal, a horizontal synchronization signal, a dot clock signal, a data enable signal, and the like, which are related to the input image data iDATA, but the present disclosure is not limited thereto.

Referring to FIG. 1, the timing controller 20 may be connected to the host system 10 using various interface methods. The timing controller 20 may perform an overall operation related to peak luminance control (PLC) driving.

The timing controller 20 may generate a power control signal CPS for controlling operation timing of the power voltage output circuit 40, a data control signal DDC for controlling operation timing of the data driver 50, and a gate control signal GDC for controlling operation timing of the gate driver 70, based on the timing control signal CON input from the host system 10 for PLC driving.

The timing controller 20 may analyze the input image data iDATA input from the host system 10 for PLC driving in a 1 image frame unit and may calculate an average picture level (APL) of each image frame. The timing controller 20 may calculate an ELVDD adjusting value AD1 and a Max adjusting value AD2 of 1 image frame based on the analysis result of input image data of the 1 image frame and PLC driving profile information read from the memory 30. The timing controller 20 may modulate the input image data iDATA of the 1 image frame based on the Max adjusting value AD2 to generate modulation image data jDATA, and may output the ELVDD adjusting value AD1 and the modulation image data jDATA of the 1 image frame to the power voltage output circuit 40 and the data driver 50, respectively.

PLC driving may be technology of reducing power consumption by lowering peak brightness of a screen image based on a preset PLC curve as an APL of the image is increased. Here, one screen image is configured via image combination using a plurality of unit pixels, and in this regard, 1 unit pixel generally includes a plurality of pixels P that embody different colors as shown in FIG. 2. Image data may be separately written in the plurality of pixels P. The APL may be defined as an average of representative image data of the input image data iDATA corresponding to 1 image amount. The representative image data may be the brightest image data among image data to be written in 1 unit pixel, and one representative image data may be extracted every 1 unit pixel.

On coordinates in which the vertical axis is target peak brightness and the horizontal axis is an APL, a PLC curve may be preset to be mapped to target peak brightness that is lowered as an APL is increased as shown in FIG. 3. Target peak brightness appropriate for each APL may be determined by a PLC curve, and in this regard, as an APL is increased, target peak brightness corresponding thereto may be lowered, and in contrast, as an APL is lowered, target peak brightness corresponding thereto may be increased. In other words, target peak brightness has the same value L1 in a low-APL region PL1 of the PLC curve, and target peak brightness may be gradually lowered to L2 (L2<L1) from L1 in a high-APL region PL2 of the PLC curve. The APL region PL2 of the PLC curve may include a plurality of APL sections that are separated at the same interval.

Peak brightness of a corresponding image during PLC driving may be determined as target peak brightness mapped to an APL of the corresponding image on the PLC curve, and the target peak brightness may be embodied by adjusting a high-potential pixel voltage ELVDD to be applied to the pixels P of the display panel 60 and the input image data iDATA. According to an aspect of the present disclosure, in order to match target peak brightness for each APL with the PLC curve, both the high-potential pixel voltage ELVDD and the Max data of each image may be adjusted for each APL, and thus, consumption power may be remarkably reduced when technology for PLC driving is embodied, and target peak brightness for each APL may be easily matched with the PLC curve. Here, the Max data may be the brightest image data among a plurality of representative image data included in each image.

In particular, according to an aspect of the present disclosure, as shown in FIG. 5, the high-potential pixel voltage ELVDD and the Max data may be adjusted in an APL section unit, and as an APL is increased, the high-potential pixel voltage ELVDD may be lowered stepwise, and as an APL is increased in 1 APL section, the Max data may be lowered to a section lower limit from a section upper limit. As such, according to an aspect of the present discourse, a power profile (hereinafter, an ELVDD reference profile PF1) for lowering the high-potential pixel voltage ELVDD stepwise as an APL is increased, and thus, consumption power may be remarkably reduced when technology for PLC driving is embodied. According to an aspect of the present disclosure, a data profile (hereinafter, a MDATA reference profile PF2) may be set to gradually lower the Max data to a section lower limit from a section upper limit as an APL is increased in 1 APL section in which the high-potential pixel voltage ELVDD is maintained constant, and thus, target peak brightness for each APL may be easily matched with the PLC curve.

According to an aspect of the present disclosure, PLC driving may be embodied according to various aspects. To this end, the timing controller 20 may be operated according to PLC driving according to first, second, and third aspects that will be described below. PLC driving according to the according to first, second, and third aspects may be optionally preset in the timing controller 20 and may be selectively applied according to a panel model and specification.

The timing controller 20 may appropriately shift the MDATA reference profile PF2 in a direction in which brightness is increased under a specific condition during PLC driving according to the first aspect, thereby preventing an issue in terms of degradation in image quality due to a Max data difference in two adjacent image frames, which will be described in detail with reference to FIGS. 10 to 17.

The timing controller 20 may appropriately shift the ELVDD reference profile PF1 and the MDATA reference profile PF2 in a direction in which brightness is increased under a specific condition during PLC driving according to the second aspect, and thus, a brightness difference due to IR drop may be effectively reduced in the same image in which 1 image frame is embodied, which will be described in detailed with reference to FIGS. 18 to 23.

Figure 24:
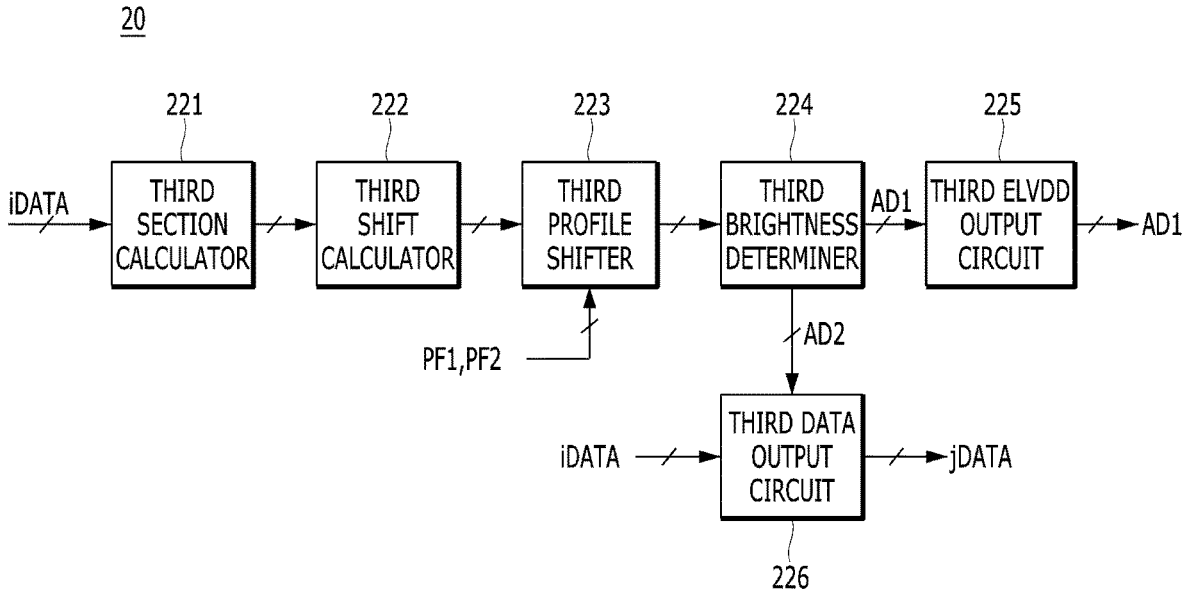
FIG. 24 is a diagram showing a configuration of a timing controller for PLC driving according to a third aspect of the present disclosure.
Figure 25:
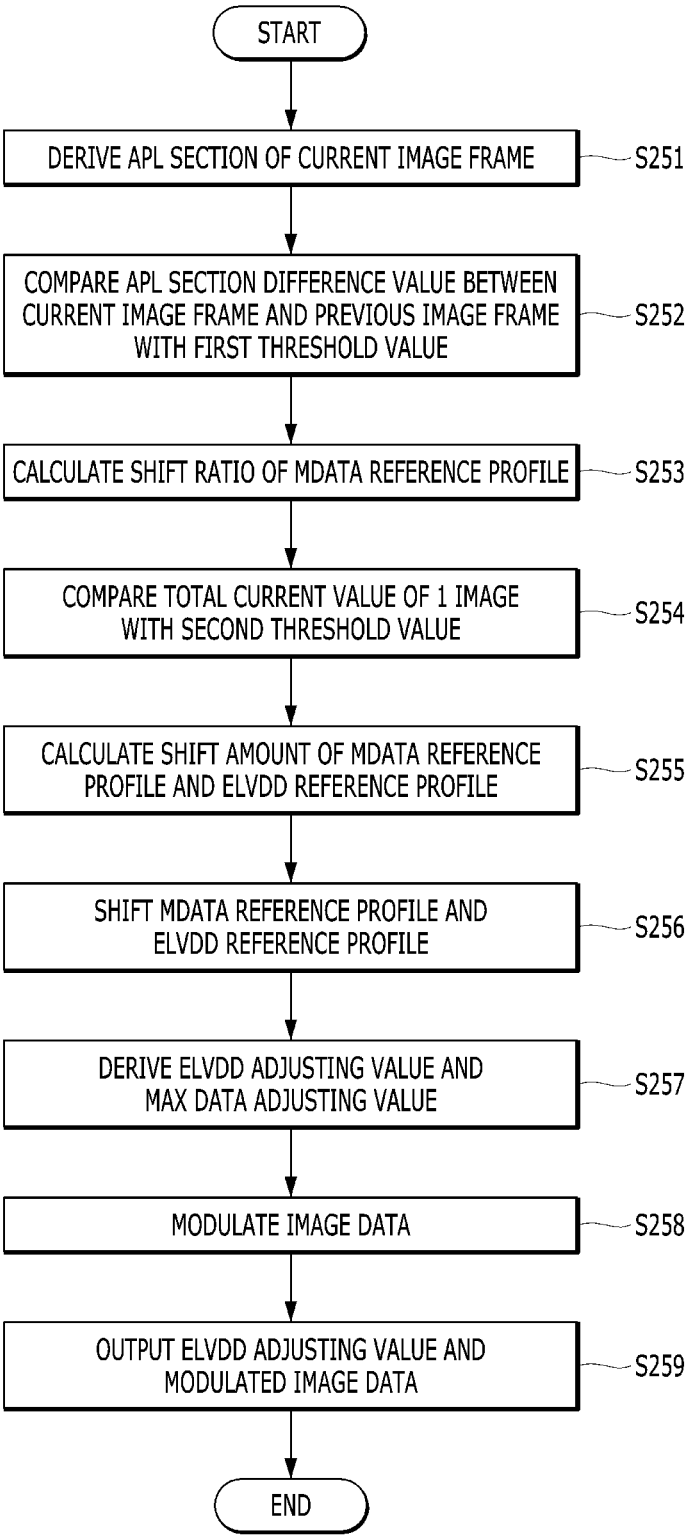
FIG. 25 is a flowchart of an operation of a timing controller for PLC driving according to the third aspect of the present disclosure.

The timing controller 20 may appropriately shift the MDATA reference profile PF2 in a direction in which brightness is increased under a specific condition during PLC driving according to the third aspect, thereby preventing an issue in terms of degradation in image quality due to a Max data difference in two adjacent image frames, and the timing controller 20 may appropriately shift the ELVDD reference profile PF1 and the MDATA reference profile PF2 in a direction in which brightness is increased, and thus, a brightness difference due to IR drop may be effectively reduced in the same image in which 1 image frame is embodied, which will be described in detail with reference to FIGS. 24 and 25.

Referring to FIGS. 1 and 2, the memory 30 may store the ELVDD reference profile PF1 and the MDATA reference profile PF2 that are required for PLC driving. The ELVDD reference profile PF1 and the MDATA reference profile PF2 may be profiles for matching target peak brightness with the PLC curve for each preset APL section. In the ELVDD reference profile PF1, ELVDD adjusting levels for adjusting the high-potential pixel voltage ELVDD to be applied to the pixels P of an image may be defined, and in the MDATA reference profile PF2, Max data adjusting values for adjusting the input image data iDATA to be applied to the pixels P of an image in 1 image frame unit may be defined. A principle of setting the ELVDD reference profile PF1 and the MDATA reference profile PF2 will be described in detail with reference to FIGS. 8 and 9.

Referring to FIGS. 1 and 2, the power voltage output circuit 40 may be connected to the timing controller 20 using various interface methods. The power voltage output circuit 40 may receive the power control signal CPS and the ELVDD adjusting value AD1 in 1 image frame unit from the timing controller 20. The power voltage output circuit 40 may generate the high-potential pixel voltage ELVDD of each image frame with reference to the ELVDD adjusting value AD1 synchronized with the power control signal CPS and may then supply the high-potential pixel voltage ELVDD to the high-potential power lines 45 connected to the pixels P of the display panel 60. The high-potential pixel voltage ELVDD may be applied to the pixels P of an image through the high-potential power lines 45.

Referring to FIGS. 1 and 2, the data driver 50 may be connected to the timing controller 20 using various interface methods. The data driver 50 may receive the data control signal DDC and the modulation image data jDATA in 1 image frame unit from the timing controller 20. The data driver 50 may convert the modulation image data jDATA into a data voltage Vdata of each image frame based on the data control signal DDC and may then supply the data voltage Vdata to data lines 55 connected to the pixels P of the display panel 60. The data voltage Vdata may be applied to the pixels P of an image through the data lines 55. The data driver 50 may include a plurality of integrated circuits (ICs) and conductive films on which the ICs are mounted.

Referring to FIGS. 1 and 2, the gate driver 70 may be connected to the timing controller 20 using various interface methods. The gate driver 70 may receive the gate control signal GDC in 1 image frame unit from the timing controller 20. The gate driver 70 may generate a scan signal SCAN based on the gate control signal GDC and then may supply the scan signal SCAN to gate lines 75 connected to the pixels P of the display panel 60. The scan signal SCAN may be applied to the pixels P of an image through the gate lines 75. The gate driver 70 may be directly formed on a non-display region of the display panel 60.

Referring to FIGS. 1 and 2, in the display panel 60, the plurality of data lines 55 and the plurality of gate lines 75 may cross each other and the pixels P may be arranged in a matrix form at intersections. The pixels P make up a screen on the display panel 60. Each pixel P may be connected to the data line 55, the gate lines 75, and the high-potential power lines 45.

As shown in FIG. 4, the pixel P may include a light emitting device OLED, a driving device DT, and a programming circuit PRC. The light emitting device OLED may emit light with brightness that is proportional to driving current Ids. The light emitting device OLED may include an organic light emitting layer but the present disclosure is not limited thereto. The light emitting device OLED may include an inorganic light emitting layer. The programming circuit PRC may include a first switch connected to the data line 55, at least one second switch connected to the gate line 75, and at least one capacitor and may set a gate-source voltage of a driving device according to a driving condition. The driving device DT may generate the driving current Ids according to the driving condition and may supply the same to the light emitting device OLED.

The data voltage Vdata may be applied to the gate-source voltage of the driving device DT, and the high-potential pixel voltage ELVDD may be applied to a drain-source voltage of the driving device DT. Thus, the data voltage Vdata and the high-potential pixel voltage ELVDD may affect the amplitude of the driving current Ids that determines brightness of the pixel P. PLC driving may be related to a problem in terms of a method of adjusting the data voltage Vdata and the high-potential pixel voltage ELVDD depending on an APL.

Figure 6:
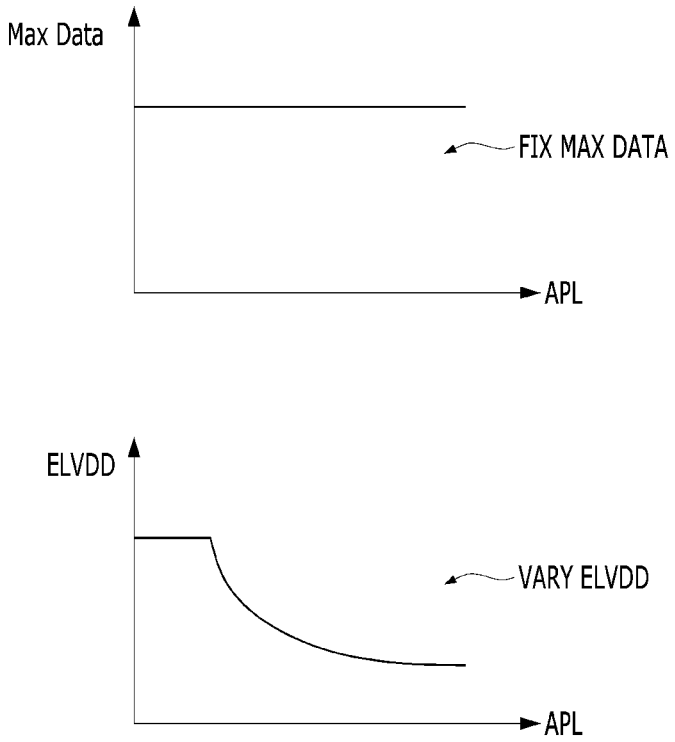
FIGS. 6 and 7 are diagrams showing PLC driving technology according to comparative examples.
Figure 7:
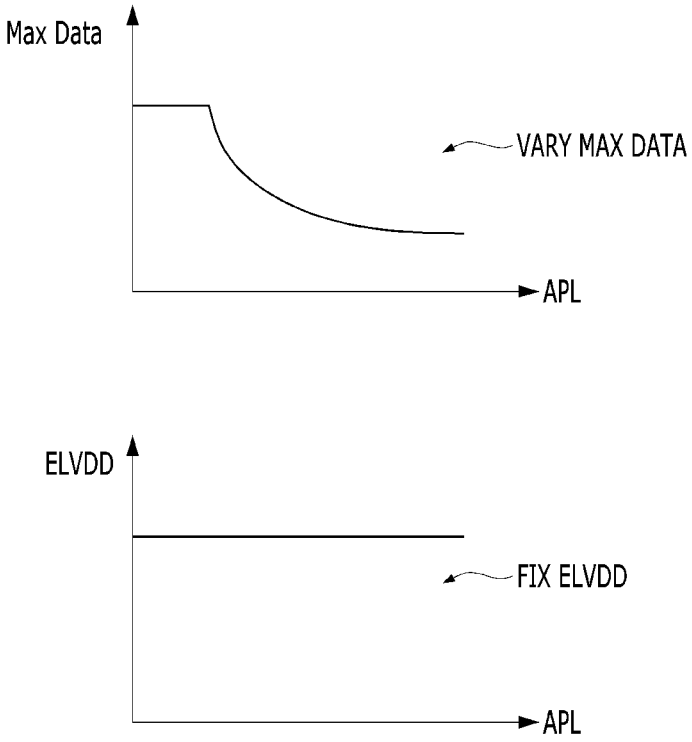

FIGS. 6 and 7 are diagrams showing PLC driving technology according to comparative examples.

Referring to FIG. 6, according to the PLC driving technology according to a first comparative example, in order to match target peak brightness for each APL with the PLC curve of FIG. 3, only the high-potential pixel voltage ELVDD may be gradually lowered in the form of a curve as an APL is increased while the Max data of each image is fixed. However, the high-potential pixel voltage ELVDD may be an analog power voltage that is commonly applied to all the pixels P, and thus, it may be very difficult to adjust the high-potential pixel voltage ELVDD in the form of a curve as shown in FIG. 6. For the PLC driving technology according to the first comparative example, the power voltage output circuit 40 for precisely outputting an analog power voltage may be required, and thus, it may be difficult to employ the power voltage output circuit 40 due to high manufacturing cost. Referring to FIG. 7, according to the PLC driving technology according to the second comparative example, in order to match target peak brightness for each APL with the PLC curve of FIG. 3, only the Max data of each image may be gradually lowered in the form of a curve as an APL is increased while the high-potential pixel voltage ELVDD is fixed. PLC driving may have a main objective of reducing consumption power, and in this regard, the PLC driving technology according to the second comparative example has a limit in reducing consumption power because the high-potential pixel voltage ELVDD is fixed.

In contrast, according to an aspect of the present disclosure, in order to match target peak brightness for each APL with the PLC curve of FIG. 3, both the high-potential pixel voltage ELVDD and the Max data of each image may be lowered for each APL section as shown in FIG. 5. For this end, EVDD adjusting levels are independently defined for each APL section, and Max data adjusting values are independently defined for each APL section.

According to an aspect of the present disclosure, the high-potential pixel voltage ELVDD may be lowered stepwise as an APL is increased. According to an aspect of the present disclosure, it may not be required to adjust the high-potential pixel voltage ELVDD in the form of a curve, and thus, the power voltage output circuit 40 that is expensive may not be required, thereby reducing manufacturing cost. According to an aspect of the present disclosure, the high-potential pixel voltage ELVDD may be lowered rather than being fixed as an APL is increased, and thus, it may be easy to reduce consumption power.

According to an aspect of the present disclosure, the Max data of an image may be lowered in a straight form as an APL is increased in the same 1 APL section in which the high-potential pixel voltage ELVDD is not changed, and thus, brightness of an image may be precisely controlled in each APL section, and accordingly, target peak brightness for each APL may be easily matched with the PLC curve.

Figure 8:
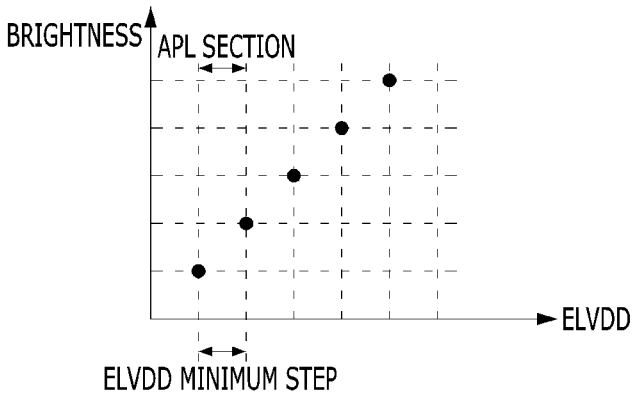
FIG. 8 is a diagram for explaining a procedure of deriving an ELVDD reference profile in which adjusting levels of a high-potential pixel voltage are predefined for each APL section.
Figure 8:
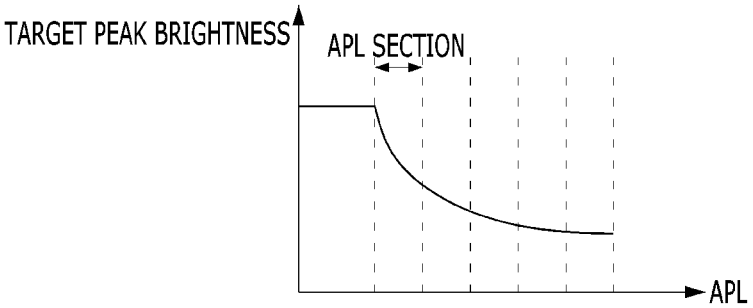
Figure 8:
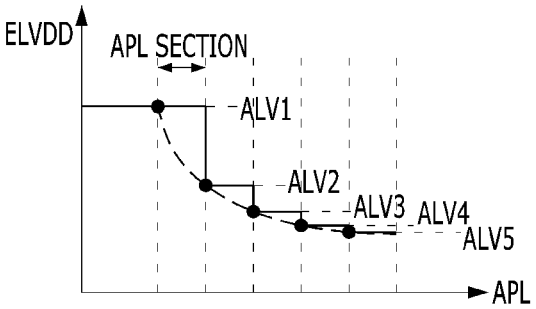
Figure 9:
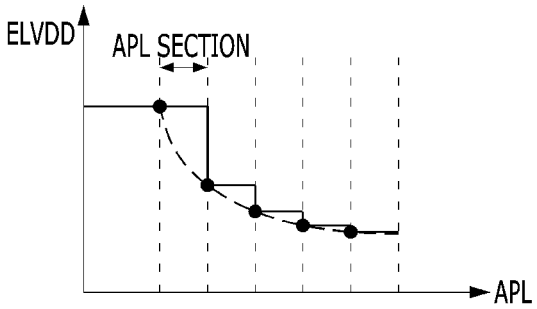
FIG. 9 is a diagram for explaining a procedure of deriving an MDATA reference profile in which an Max data adjusting values are predefined for each APL.
Figure 9:
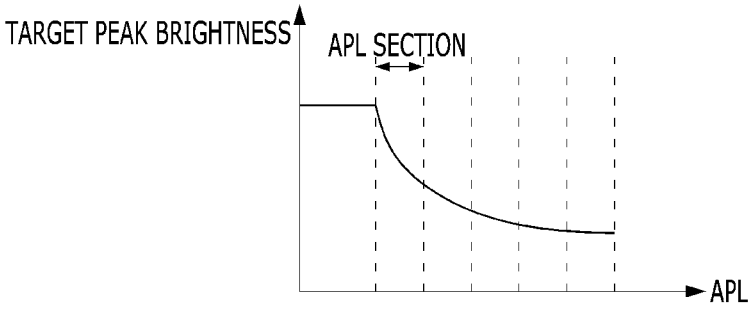
Figure 9:
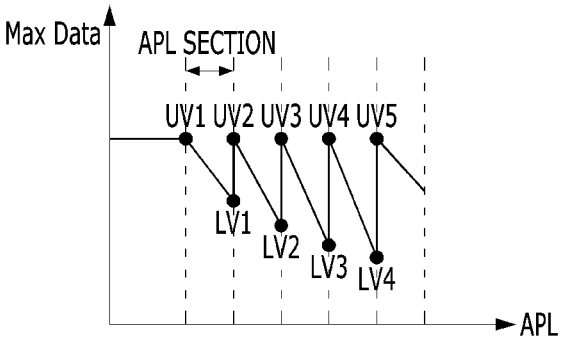

FIG. 8 is a diagram for explaining a procedure of deriving an ELVDD reference profile. FIG. 9 is a diagram for explaining a procedure of deriving an MDATA reference profile.

Referring to FIG. 8, the ELVDD reference profile illustrated in FIG. 8C defines adjusting levels ALV1 to ALV5 of the high-potential pixel voltage ELVDD for each APL section by mapping brightness points (refer to FIG. 8A) for each ELVDD to a target peak brightness (refer to FIG. 8B) for each APL, which is a PLC curve. The adjusting levels ALV1 to ALV5 of the high-potential pixel voltage ELVDD may be gradually lowered with an increase in APL and may have a stepwise form. The ELVDD reference profile may be preset depending on PLC driving in an optical compensation stage before product release and may be stored in a memory. Here, optical compensation refers to post processing technology for matching the optical characteristics (color coordinates or brightness) of a display panel within a target range. The optical compensation technology measures the color coordinates and brightness of an image by applying a voltage or current corresponding to specific gray scale values to a completed displayed panel and repeatedly measures the color coordinates and brightness of the image while a gamma value is changed until the measurement result belongs to a desired target range. In FIG. 8A, brightness points for each ELVDD may be a value determined according to design specification of the power voltage output circuit 40 and may be set in units of APL sections in an optical compensation stage. A PLC curve illustrated in FIG. 8B may be predetermined according to design specification of a display panel.

Referring to FIG. 9, an MDATA reference profile illustrated in FIG. 9C defines Max data adjusting values of the input image data iDATA for each APL by mapping an ELVDD reference profile (refer to FIG. 9A) to a target peak brightness (refer to FIG. 9B) for each APL, which is a PLC curve. The Max data adjusting values of the input image data iDATA may be relatively rapidly changed at boundary portions of adjacent APL sections and may be embodied in the form of a saw tooth. In other words, the Max data adjusting values may be lowered in the form of a diagonal line to a Max data section lower limit (e.g., LV1) from a Max data section upper limit (e.g., UV1) with an increase in APL within a 1 APL section. In APL sections, when Max data section upper limits UV1 to UV5 and Max data section lower limits LV1 to LV4 are alternately connected, a ramp (or a saw tooth) form may be achieved. In particular, for ease of brightness matching, the Max data section upper limits UV1 to UV5 of APL sections may be equally set irrespective of a change in APL, and the Max data section lower limits LV1 to LV4 of the APL sections may be set to be gradually lowered with an increase in APL.

Drawings of the specification illustrate only the case in which Max data adjusting values are lowered in the form of a diagonal line, a saw tooth, or a ramp with an increase in APL in 1 APL section, but the technological idea of the present disclosure is not limited thereto. In the 1 APL section, the change form in the Max data adjusting values may be variously set. For example, the Max data adjusting values may be lowered in the form of a parabola or in the combined form of a diagonal line and a parabola to the Max data section lower limit from the Max data section upper limit with an increase in APL in the 1 APL section. FIGS. 10 to 17 are diagrams for explaining the configuration, the operation, etc. of a timing controller for PLC driving according to the first aspect of the present disclosure.

Figure 10:
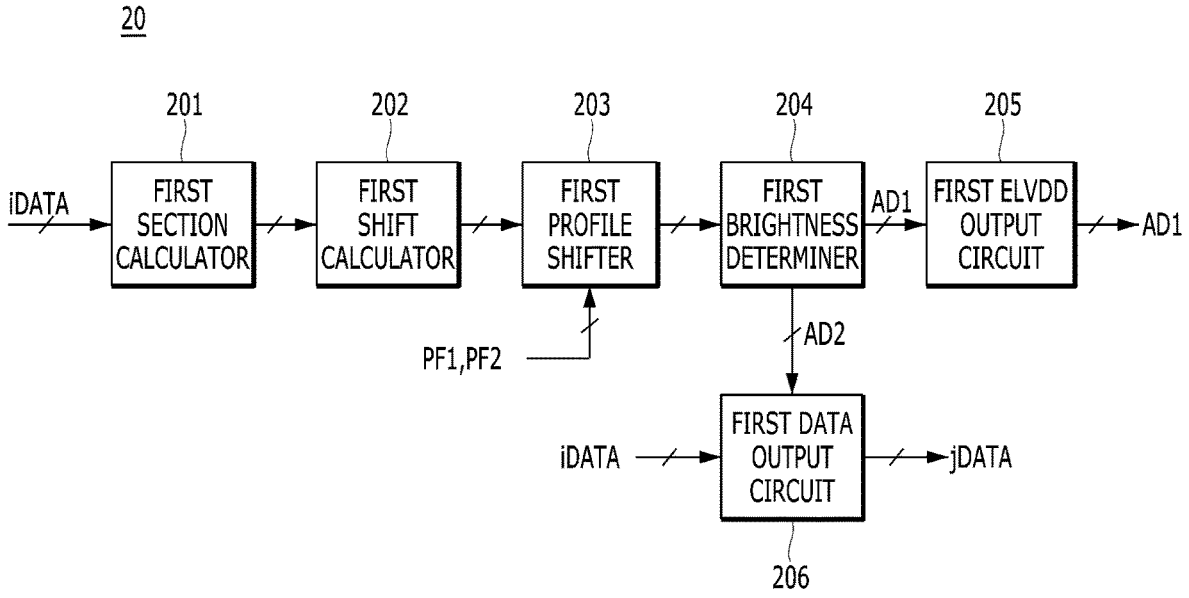
FIG. 10 is a diagram showing a configuration of a timing controller for PLC driving according to a first aspect of the present disclosure.

Referring to FIG. 10, the timing controller 20 according to the first aspect of the present disclosure may include a first section calculator 201, a first shift calculator 202, a first profile shifter 203, a first brightness determiner 204, a first ELVDD output circuit 205, and a first data output circuit 206.

Figure 11:
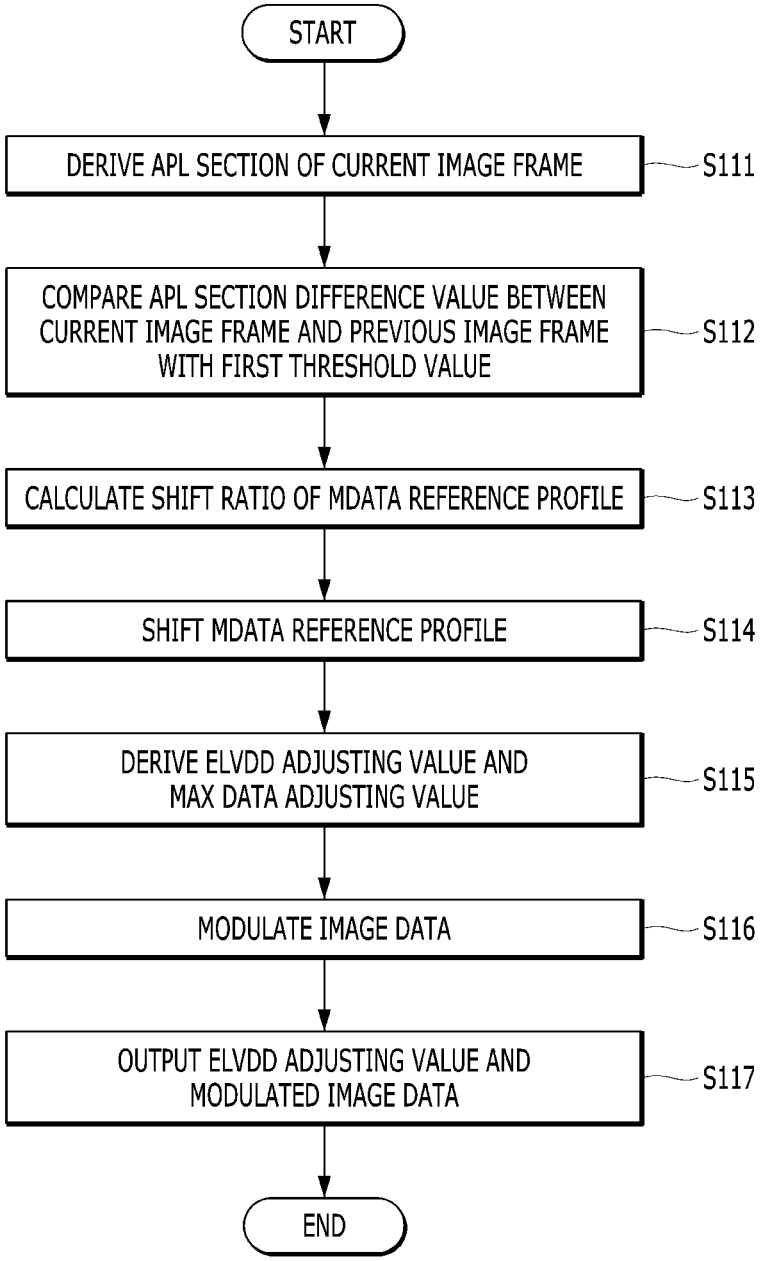
FIG. 11 is a flowchart of an operation of a timing controller for PLC driving according to the first aspect of the present disclosure.

As shown in FIG. 11, the first section calculator 201 may calculate a first APL of the input image data iDATA of a first image frame (hereinafter, a current image frame) received from the host system 10 and may derive a first APL section to which the first APL belongs (S111). The first section calculator 201 may calculate the first APL by averaging brightness of representative image data of the input image data iDATA of the current image frame. The first section calculator 201 may derive the first APL section to which the first APL belongs with reference to APL section information pre-stored in an internal register.

As shown in FIG. 11, the first shift calculator 202 may compare the first APL section and the second APL section with reference to the second APL section that is pre-derived from a second image frame (hereinafter, a previous image frame) that is temporally previously adjacent to the current image frame and may calculate a shift ratio of a MDATA reference profile according to the comparison result of the first APL section and the second APL section. The first shift calculator 202 may calculate a shift ratio of the MDATA reference profile to be greater than 0% when an APL section difference as the comparison result of the first APL section and the second APL section is equal to or greater than a preset first threshold value, and may calculate a shift ratio of the MDATA reference profile to 0% when the APL section difference is less than the preset first threshold value (S112 and S113).

Figure 12:
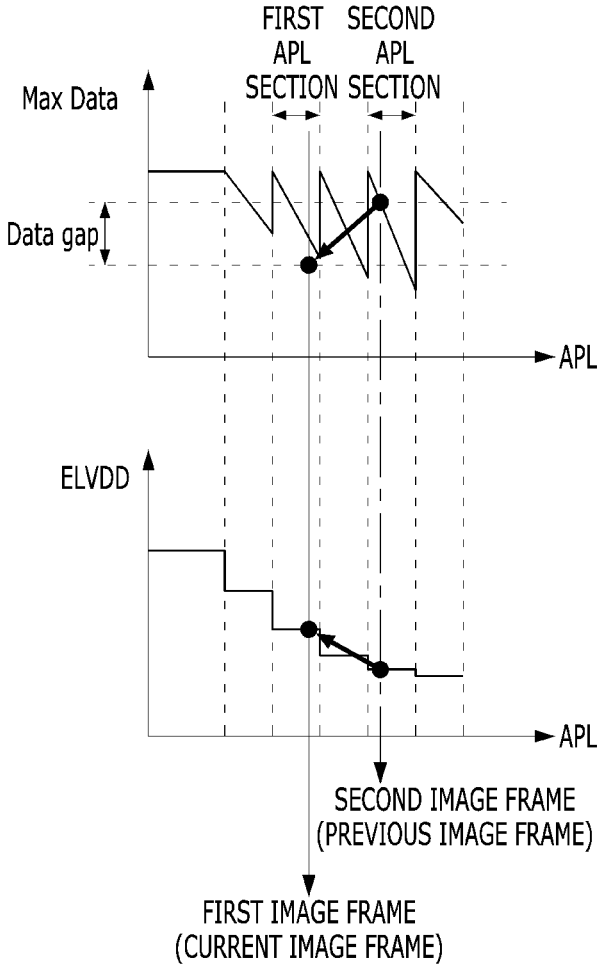
FIGS. 12 and 13 are diagrams for explaining the reason for an issue in terms of image quality due to an APL section difference between adjacent image frames during PLC driving.
Figure 13:
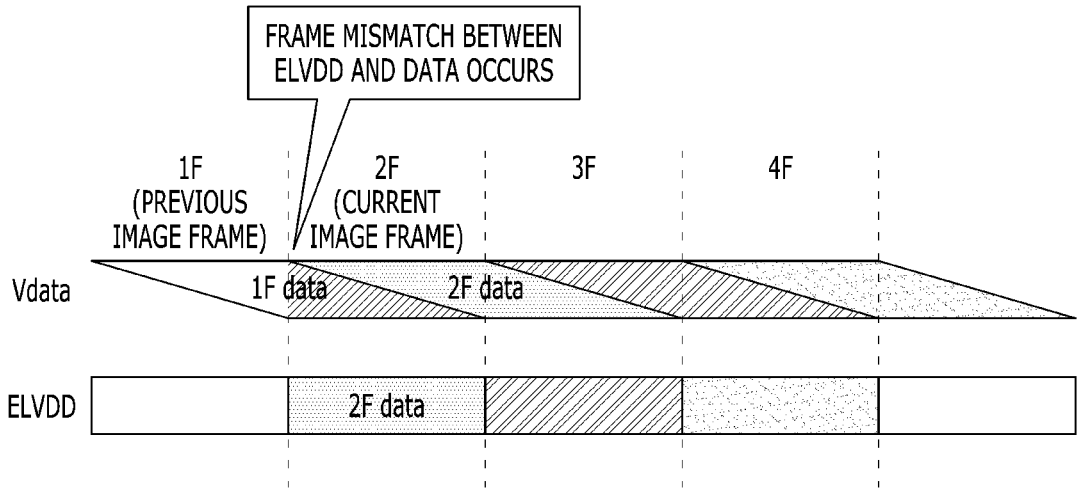

As such, the shift ratio of the MDATA reference profile is calculated in order to prevent an issue of image quality due to a difference in Max data of two adjacent image frames. In detail, as illustrated in FIGS. 12 and 13, assuming that an image frame is chanted to a current image frame (e.g., 2F) from a previous image frame (e.g., 1F), a time point of changing the data voltage Vdata for embodying an image during the current image frame and a time point of changing the high-potential pixel voltage ELVDD may be changed. That is, the high-potential pixel voltage ELVDD may be simultaneously changed at all positions of a display panel within the current image frame, but the data voltage Vdata may be changed while being sequentially addressed in units of pixel lines in a gate scan order. Pixels may be maintained in a data state of the previous image frame until data addressing is performed during the current image frame, and may be written with the data voltage Vdata of the current image frame in synchronization with data addressing. Thus, mismatching inevitably occurs between the high-potential pixel voltage ELVDD and the data voltage Vdata on a screen of the display panel 60. Here, mismatching means that PLC driving is performed according to the high-potential pixel voltage ELVDD of the current image frame and the data voltage Vdata of the previous image frame. The data voltage Vdata of the previous image frame may be a digital-analog conversion result of modulation image data of the previous image frame, and the modulation image data may be modulated according to the Max data of the previous image frame, and thus, when PLC driving is embodied according to the mismatching, an issue in image quality may occur.

The first shift calculator 202 may calculate the shift ratio of the MDATA reference profile PF2 to be greater than 0% only when an APL section difference between adjacent image frames is equal to or greater than a first threshold value, and may calculate the shift ratio of the MDATA reference profile PF2 to 0% when the APL section difference is less than the first threshold value. This is because the issue in terms of image quality is problematic only when the APL section difference is equal to or greater than the first threshold value, and the issue in terms of image quality is not substantially problematic when the APL section difference is less than the first threshold value.

Figure 14:
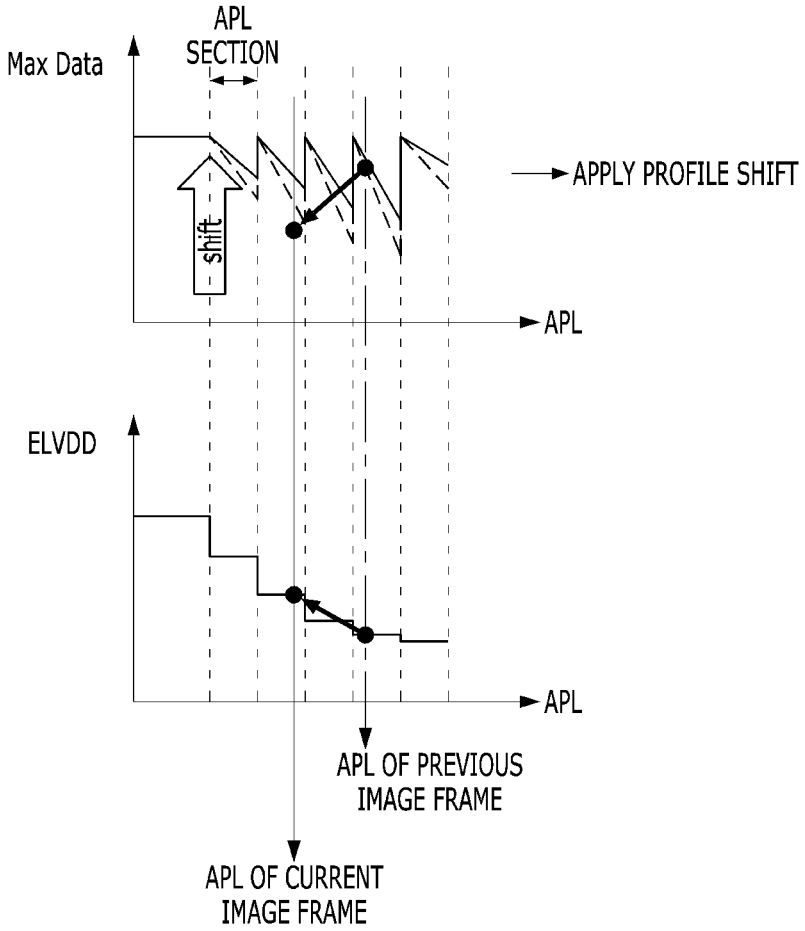
FIGS. 14 and 15 are diagrams for explaining a reference for determining whether shift is applied to an MDATA reference profile in PLC driving according to the first aspect of the present disclosure.
Figure 15:
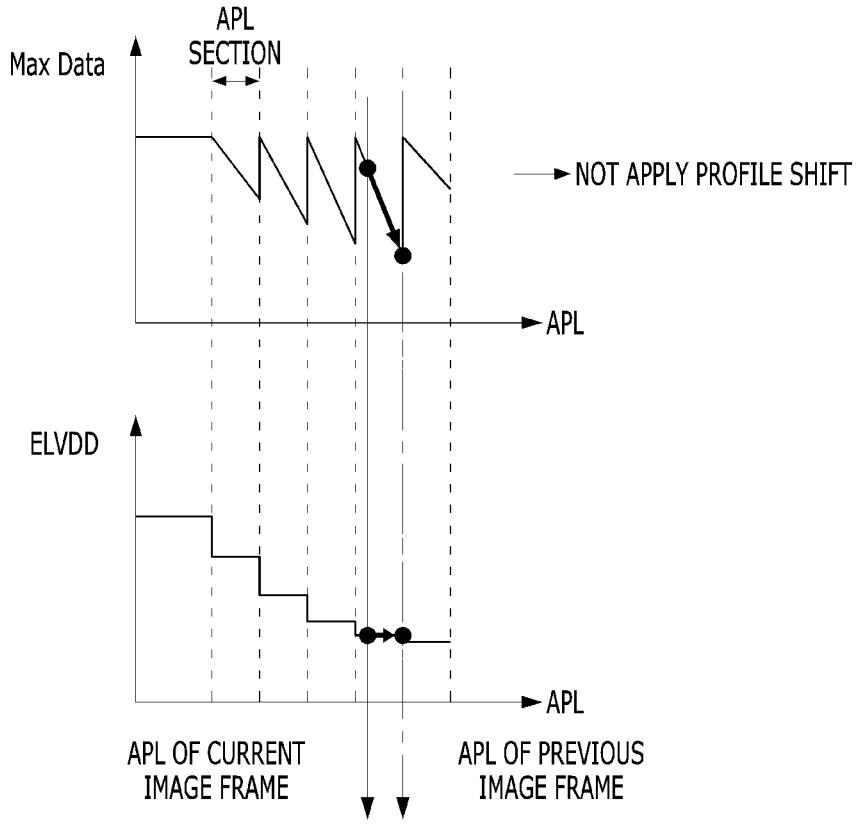

For example, when the first threshold value is set to "1 APL section", the first shift calculator 202 may calculate a shift ratio of the MDATA reference profile PF2 to be larger than 0% in a current image frame in which the APL section difference is greater than the first threshold value as shown in FIG. 14, and the first shift calculator 202 may calculate the shift ratio of the MDATA reference profile PF2 to 0% in a current image frame in which the APL section difference is smaller than the first threshold value as shown in FIG. 15.

When the APL section difference between the current image frame and the previous image frame is high, in proportion to this, an adjusting level difference in the high-potential pixel voltage ELVDD for PLC driving between the opposite frames may be high, and a difference in the adjusting value of the Max data to be matched to the high-potential pixel voltage ELVDD may also be increased. As a result, when the APL section difference between the opposite frames is high, the issue in terms of image quality may be more problematic.

Thus, in a condition in which the APL section period is equal to or greater than the first threshold value, the first shift calculator 202 may overcome the issue in terms of image quality by increasing the shift ratio of the MDATA reference profile PF2 in proportion to the APL section difference.

Figure 16A:
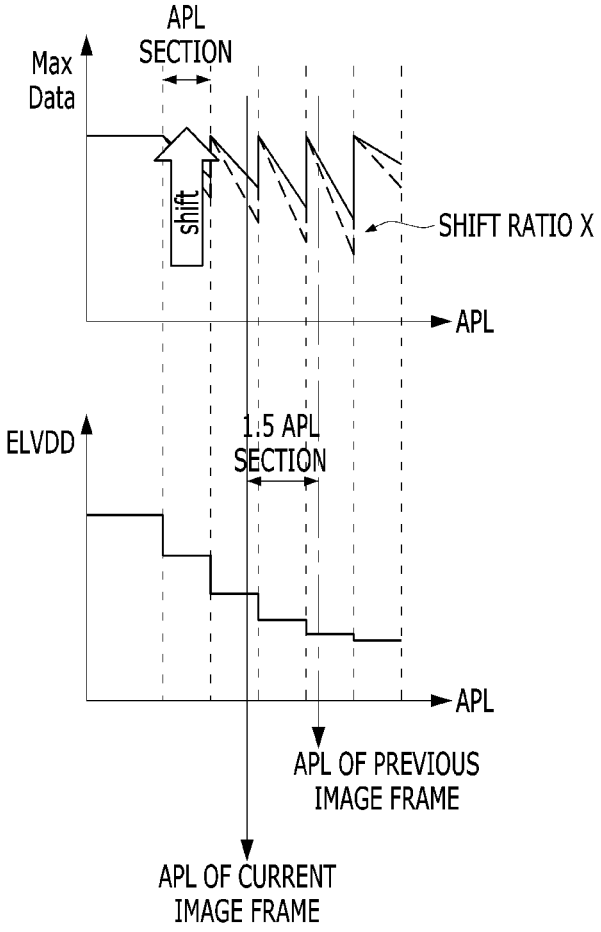
FIGS. 16A and 16B are diagrams for explaining a reference for determining a shift amount of an MDATA reference profile in PLC driving according to the first aspect of the present disclosure.
Figure 16B:
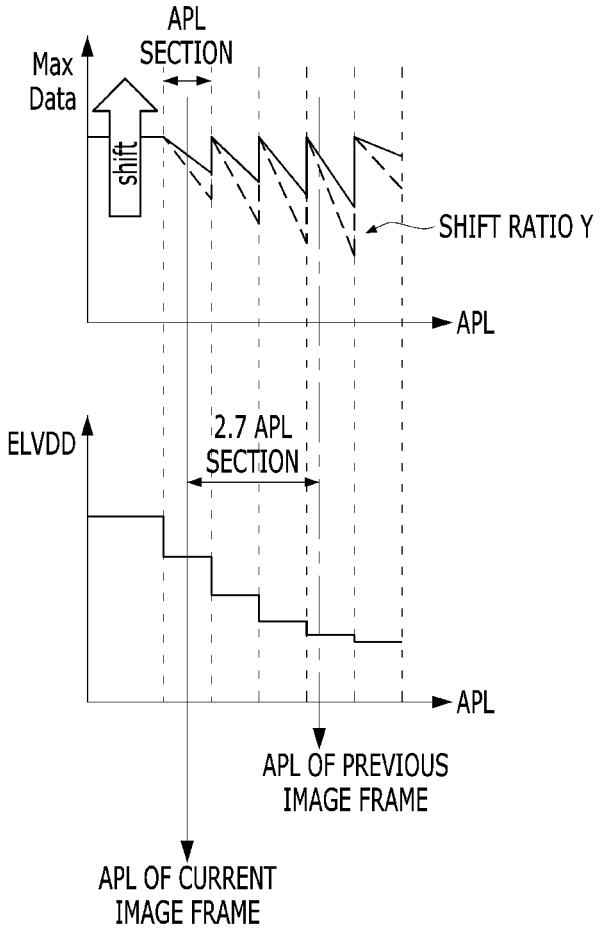

For example, when the first threshold value is set to "1 APL section", the first shift calculator 202 may calculate the shift ratio of the MDATA reference profile PF2 to "X" in the current image frame in which the APL section difference is approximately "1.5 APL section" as shown in FIG. 16A, and in contrast, the first shift calculator 202 may calculate the shift ratio of the MDATA reference profile PF2 to "Y" greater than "X" in the current image frame in which the APL section difference is approximately "2.7 APL section" as shown in FIG. 16B.

The first profile shifter 203 may download the ELVDD reference profile PF1 and the MDATA reference profile PF2 from the memory 30 and may receive the shift ratio of the MDATA reference profile PF2 from the first shift calculator 202. As shown in FIG. 11, the first profile shifter 203 may shift the MDATA reference profile to reduce a difference between the Max data section upper limit and the Max data section lower limit in each APL section according to the shift ratio of the MDATA reference profile PF2 (S114).

Figure 17:
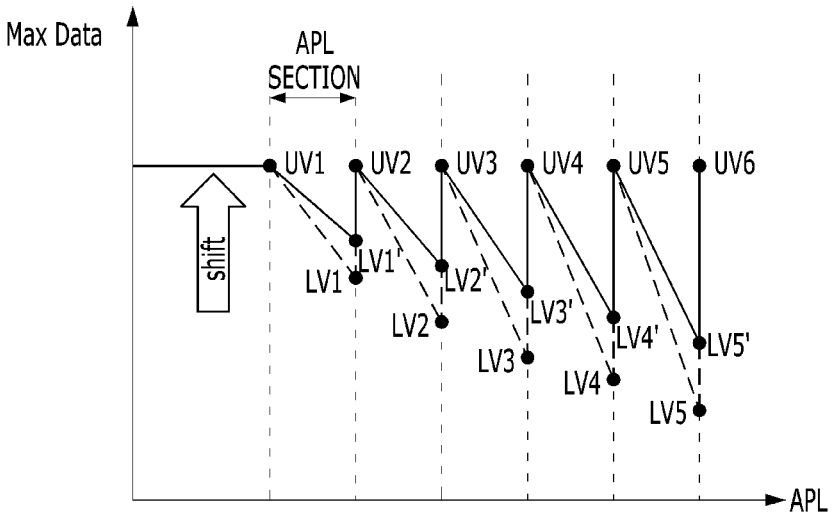
FIG. 17 is a diagram for explaining a detailed shift form of an MDATA reference profile in PLC driving according to the first aspect of the present disclosure.

In other words, as shown in FIG. 17, the first profile shifter 203 may equally fix Max data section upper limits UV1 to UV6 in each APL section, and may shift the Max data section lower limits LV1 to LV5 in each APL section according to the shift ratio of the MDATA reference profile in a direction in which data is increased. As a result, the Max data section lower limits LV1 to LV5 may be changed to new values LV1' to LV5', and may be changed in the same ratio depending on the shift ratio of the MDATA reference profile. That is, as shown in FIG. 17, all of (LV1'-LV1)/(UV2-LV1), (LV2'-LV2)/(UV3-LV2), (LV3'-LV3)/(UV4-LV3), (LV4'-LV4)/(UV5-LV4), and (LV5'-LV5)/(UV6-LV5) may be the same.

The first brightness determiner 204 may receive the ELVDD reference profile PF1 and the shifted MDATA reference profile from the first profile shifter 203. As shown in FIG. 11, the first brightness determiner 204 may derive the EVDD adjusting value AD1 mapped to the first APL section from the ELVDD reference profile PF1, and may derive the max adjusting value AD2 mapped to the first APL from the shifted MDATA reference profile (S115). The first brightness determiner 204 may receive the non-shifted MDATA reference profile PF2 from the first profile shifter 203, and in this case, may derive the max adjusting value AD2 mapped to the first APL from the non-shifted MDATA reference profile PF2 (S115).

As shown in FIG. 11, the first ELVDD output circuit 205 may output the EVDD adjusting value AD1 received from the first brightness determiner 204 to the power voltage output circuit 40 (S117).

The first data output circuit 206 may receive the input image data iDATA of the current image frame from the host system 10, and may receive the max adjusting value AD2 from the first brightness determiner 204. As shown in FIG. 11, the first data output circuit 206 may modulate the input image data iDATA of the current image frame based on the max adjusting value AD2 and may output the modulation image data jDATA to the data driver 50 (S116 and S117).

FIGS. 18 to 23 are diagrams for explaining the configuration, the operation, etc. of a timing controller for PLC driving according to the second aspect of the present disclosure.

Figure 18:
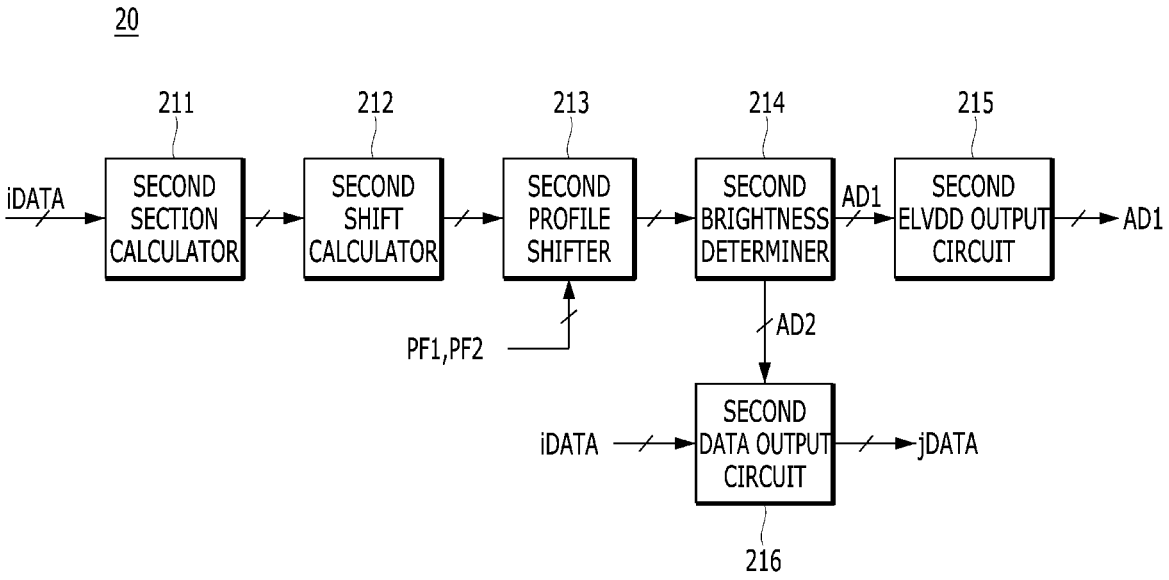
FIG. 18 is a diagram showing a configuration of a timing controller for PLC driving according to a second aspect of the present disclosure.

Referring to FIG. 18, the timing controller 20 according to the second aspect of the present disclosure may include a second section calculator 211, a second shift calculator 212, a second profile shifter 213, a second brightness determiner 214, a second ELVDD output circuit 215, and a second data output circuit 216.

Figure 19:
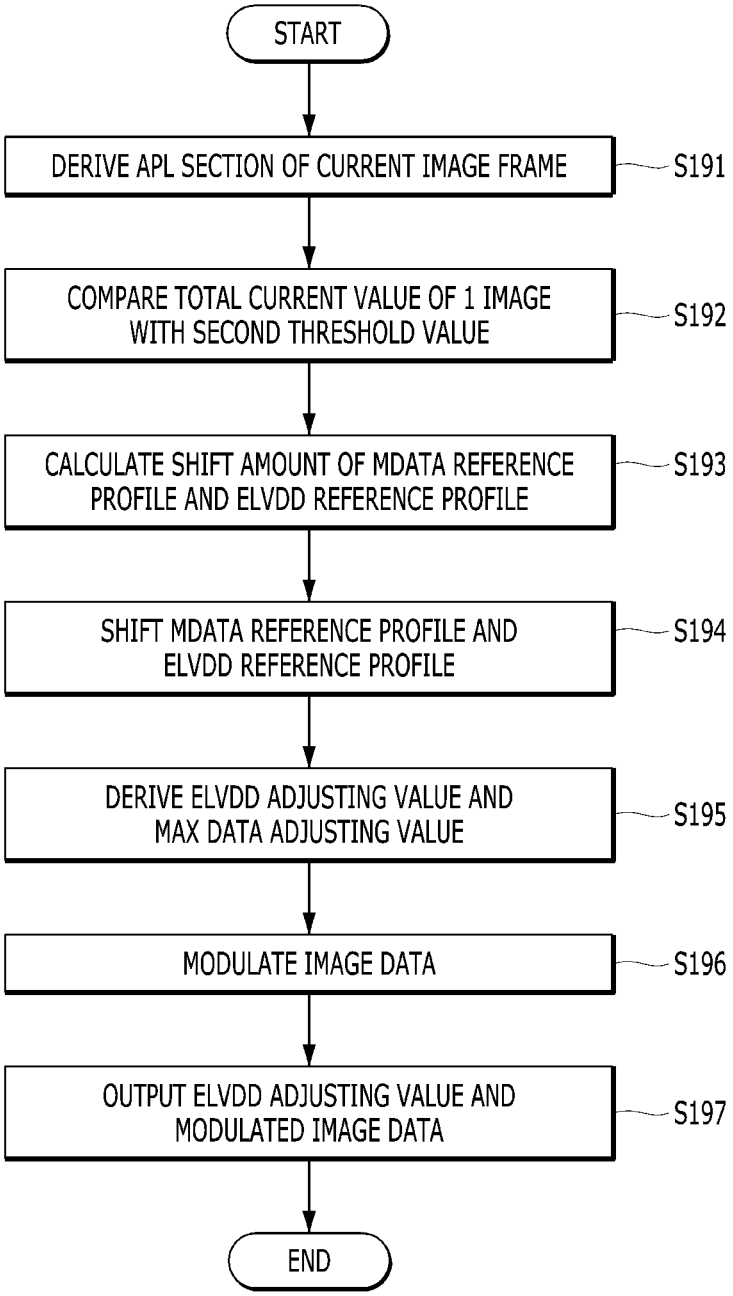
FIG. 19 is a flowchart of an operation of a timing controller for PLC driving according to the second aspect of the present disclosure.

As shown in FIG. 19, the second section calculator 211 may calculate a first APL of the input image data iDATA of a first image frame (hereinafter, a current image frame) received from the host system 10 and may derive the first APL section to which the first APL belongs (S191). The second section calculator 211 may calculate the first AP by averaging brightness of representative image data of the input image data iDATA of the current image frame. The second section calculator 211 may derive the first APL section to which the first APL belongs with reference to the APL section information pre-stored in an internal register.

As shown in FIG. 19, the second shift calculator 212 may calculate a total current value of 1 image, which flows in pixels of an image depending on the input image data iDATA of the current image frame and may calculate a reference profile shift amount of the ELVDD reference profile PF1 and the MDATA reference profile PF2 depending on the total current of the 1 image. The second shift calculator 212 may compare the total current value of the 1 image with a preset second threshold value. When the total current value of the 1 image is equal to or greater than the preset second threshold value, the second shift calculator 212 may calculate the reference profile shift amount to be equal to or greater than at least 1 APL section, and when the total current value of the 1 image is less than the second threshold value, the second shift calculator 212 may not calculate the reference profile shift amount (S192 and S193).

Figure 20:
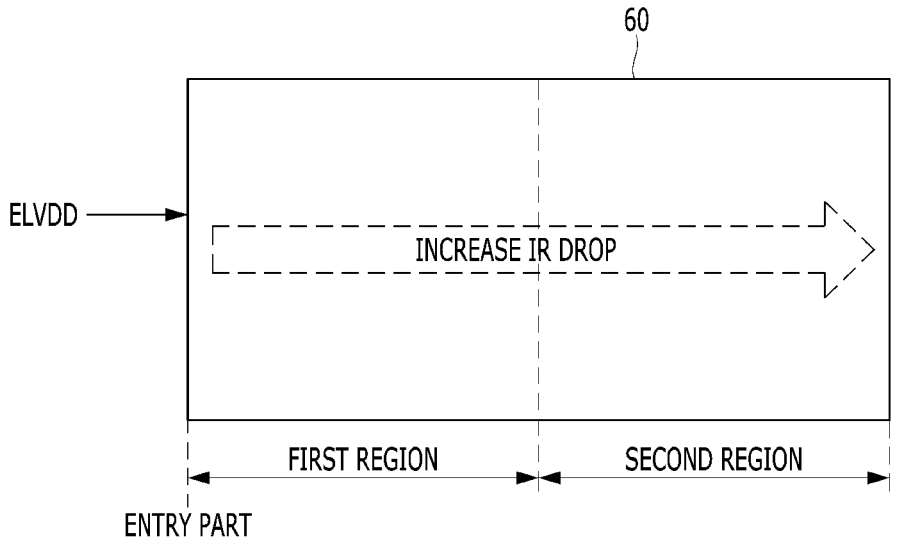
FIG. 20 is a diagram for explaining reduction in brightness due to IR drop of a high-potential pixel voltage on a display panel during PLC driving.

As such, the reference profile shift amount of the ELVDD reference profile PF1 and the MDATA reference profile PF2 may be calculated in order to compensate for a deviation of the high-potential pixel voltage ELVDD and brightness distortion therefrom due to IR drop on a screen of the display panel 60. The IR drop may refer to ohmic drop that occurs in a high-potential power line for supplying the high-potential pixel voltage ELVDD to the pixels P and may be represented by the product of current and resistance. An IR drop amount in the screen of the display panel 60 may be increased as the total current of 1 image and resistance are increased. Here, resistance is proportional to the length of a current transfer path, and thus, resistance may be lowest at an entry part of the high-potential pixel voltage ELVDD and may be increased apart from the entry part of the high-potential pixel voltage ELVDD. Thus, an IR drop amount may be higher in a second region that is relatively far from the entry part of the high-potential pixel voltage ELVDD than in the first region that is relatively close to the entry part of the high-potential pixel voltage ELVDD, as shown in FIG. 20. When the IR drop is increased, an issue in terms of image quality due to brightness distortion may be caused.

The second shift calculator 212 may increase the reference profile shift amount in proportion to a total current value of 1 image in a condition in which the total current value of 1 image is equal to or greater than the second threshold value, and thus, brightness distortion due to the IR drop may be minimized.

The second shift calculator 212 may increase the IR drop amount in the second region that is relatively far from the entry part of the high-potential pixel voltage ELVDD than in the first region that is relatively close to the entry part of the high-potential pixel voltage ELVDD, and may minimize brightness distortion between the first and second regions due to the IR drop.

As shown in FIG. 19, the second profile shifter 213 may download the ELVDD reference profile PF1 and the MDATA reference profile PF2 from the memory 30 and may receive the reference profile shift amount from the second shift calculator 212.

Figure 22:
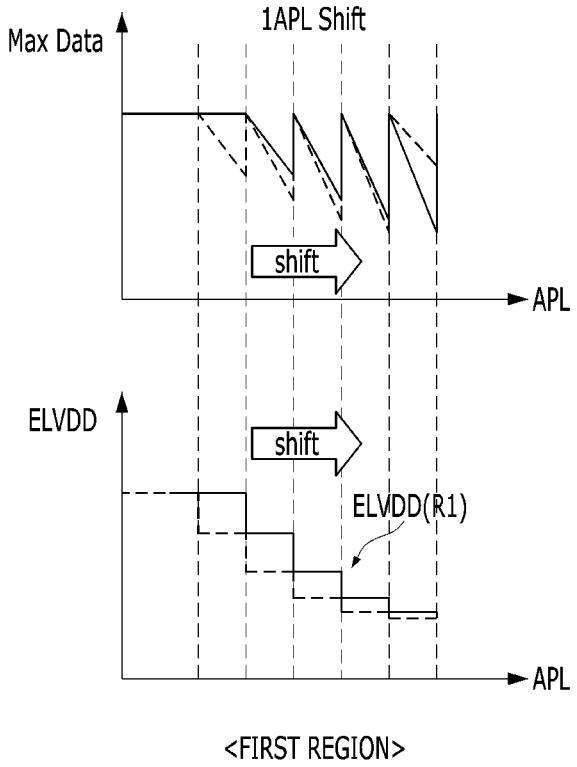
FIGS. 22 and 23 are diagrams for explaining the case in which a shift amount of an MDATA reference profile and an ELVDD reference profile is differentially applied in PLC driving according to the second aspect of the present disclosure.
Figure 23:
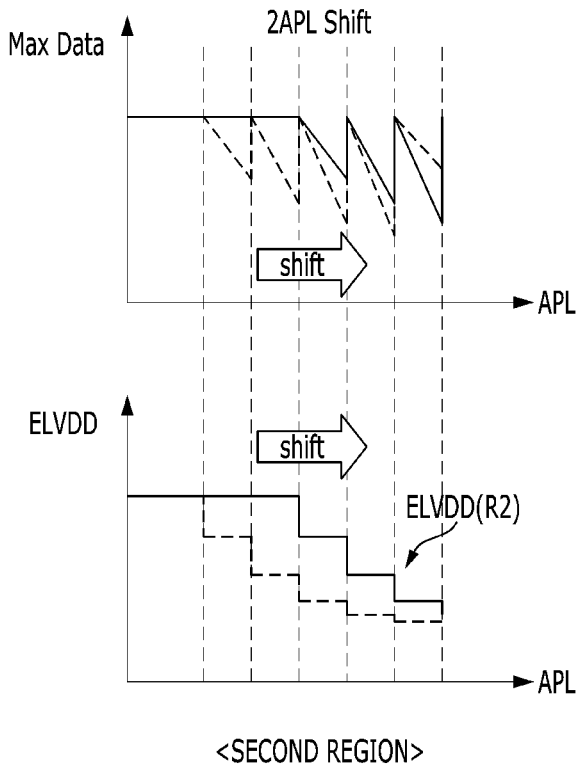

As shown in FIG. 22 or 23, the second profile shifter 213 may fix the form of the ELVDD reference profile PF1 and the MDATA reference profile PF2 and may shift the ELVDD reference profile PF1 and the MDATA reference profile PF2 depending on the reference profile shift amount in a direction in which an APL is increased (S194).

The second profile shifter 213 may fix the form of the ELVDD reference profile PF1 and the MDATA reference profile PF2 and may shift the ELVDD reference profile PF1 and the MDATA reference profile PF2 depending on the reference profile shift amount in a direction in which an APL is increased, and in this case, as shown in FIG. 22, the second profile shifter 213 may shift the ELVDD reference profile PF1 and the MDATA reference profile PF2 in response to the first region by as much as the first APL section in a direction in which an APL is increased, and as shown in FIG. 23, the second profile shifter 213 may shift the ELVDD reference profile PF1 and the MDATA reference profile PF2 in response to the second region by as much as the second APL section larger than the first APL section in a direction in which an APL is increased.

Figure 21:
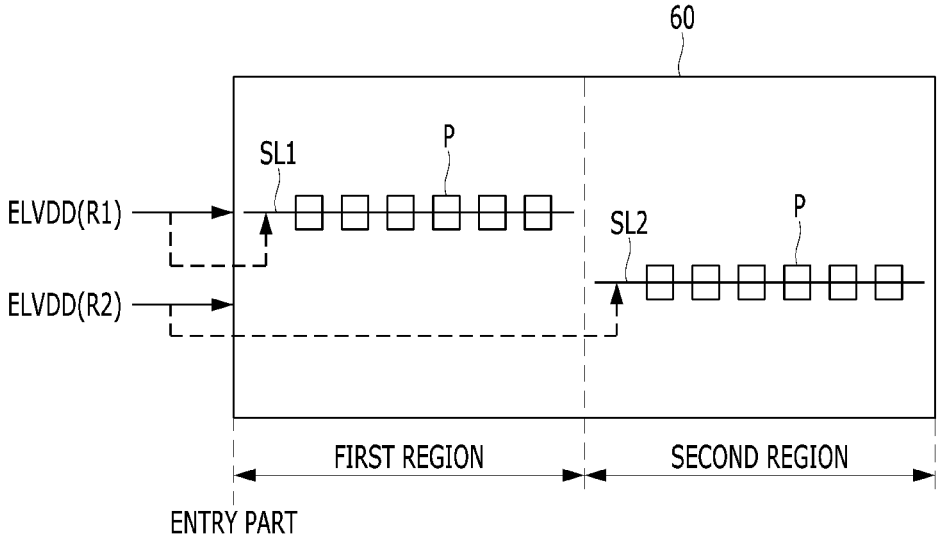
FIG. 21 is a diagram for explaining a method of shifting an MDATA reference profile and an ELVDD reference profile depending on PLC driving for preventing brightness from being lowered due to IR drop according to the second aspect of the present disclosure.

As such, when the shift amount of the ELVDD reference profile PF1 is changed with respect to the first region and the second region of an image, the first region and the second region may be assumed to be separately driven as shown in FIG. 21. Through separate driving, the high-potential pixel voltage ELVDD may be input with different amplitudes ELVDD(R1) and ELVDD(R2) to the first region and the second region in the same frame. For separate driving, the pixels P of the first region may be connected to the entry part of the high-potential pixel voltage ELVDD through a first EVDD supply line SL1, the pixels P of the second region may be connected to the entry part of the high-potential pixel voltage ELVDD through a second EVDD supply line SL2, and the first EVDD supply line SL1 and the second EVDD supply line SL2 may be separated from each other. The first EVDD supply line SL1 and the second EVDD supply line SL2 may be included in the high-potential power lines 45 illustrated in FIGS. 2 and 4.

The second brightness determiner 214 may receive a received ELVDD reference profile and a shifted MDATA reference profile from the second profile shifter 213. As shown in FIG. 19, the second brightness determiner 214 may derive the EVDD adjusting value AD1 mapped to the first APL section from the shifted ELVDD reference profile, and may derive the max adjusting value AD2 mapped to the first APL from the shifted MDATA reference profile (S195). The second brightness determiner 214 may receive the non-shifted ELVDD reference profile PF1 and the non-shifted MDATA reference profile PF2 from the second profile shifter 213, and in this case, may derive the EVDD adjusting value AD1 mapped to the first APL section from the ELVDD reference profile PF1 and may derive the max adjusting value AD2 mapped to the first APL from the MDATA reference profile PF2 (S195).

As shown in FIG. 19, the second ELVDD output circuit 215 may output the EVDD adjusting value AD1 input from the second brightness determiner 214, to the power voltage output circuit 40 (S197).

The second data output circuit 216 may receive the input image data iDATA of the current image frame from the host system 10 and may receive the max adjusting value AD2 from the second brightness determiner 214. As shown in FIG. 19, the second data output circuit 216 may modulate the input image data iDATA of current image frame based on the Max adjusting value AD2 and may output the modulation image data jDATA to the data driver 50 (S196 and S197).

FIGS. 24 and 25 are diagrams for explaining the configuration, the operation, etc. of a timing controller for PLC driving according to the third aspect of the present disclosure. The PLC driving according to the third aspect may be obtained by combining PLC driving according to the first and second aspects.

Referring to FIG. 24, the timing controller 20 according to the third aspect of the present disclosure may include a third section calculator 221, a third shift calculator 222, a third profile shifter 223, a third brightness determiner 224, a third ELVDD output circuit 225, and a third data output circuit 226.

As shown in FIG. 25, the third section calculator 221 may calculate the first APL of the input image data iDATA of the first image frame (hereinafter, the current image frame) received from the host system 10 and may derive the first APL section to which the first APL belongs (S251). The third section calculator 221 may derive the first APL by averaging brightness of representative image data of the input image data iDATA of the current image frame. The third section calculator 221 may derive the first APL section to which the first APL belongs with reference to APL section information pre-stored in an internal register.

As shown in FIG. 25, the third shift calculator 222 may compare the first APL section and the second APL section with reference to the second APL section that is pre-derived from a second image frame (hereinafter, a previous image frame) that is temporally previously adjacent to the current image frame and may calculate a shift ratio of a MDATA reference profile according to the comparison result of the first APL section and the second APL section. The third shift calculator 222 may calculate a shift ratio of the MDATA reference profile to be greater than 0% when an APL section difference as the comparison result of the first APL section and the second APL section is equal to or greater than a preset first threshold value, and may calculate a shift ratio of the MDATA reference profile to 0% when the APL section difference is less than the preset first threshold value (S252 and S253). The third shift calculator 222 may increase the shift ratio of the MDATA reference profile PF2 in proportion to the APL section in an condition in which the APL section difference is equal to or greater than the first threshold value.

Then, as shown in FIG. 25, the third shift calculator 222 may calculate a total current value of 1 image, which flows in pixels of an image depending on the input image data iDATA of the current image frame and may calculate a reference profile shift amount of the ELVDD reference profile PF1 and the MDATA reference profile PF2 depending on the total current of the 1 image. The third shift calculator 222 may compare the total current value of the 1 image with a preset second threshold value. When the total current value of the 1 image is equal to or greater than the preset second threshold value, the third shift calculator 222 may calculate the reference profile shift amount to be equal to or greater than at least 1 APL section, and when the total current value of the 1 image is less than the second threshold value, the third shift calculator 222 may not calculate the reference profile shift amount (S254 and S255). In a condition in which the total current value of the 1 image is equal to or greater than the preset second threshold value, the third shift calculator 222 may increase the reference profile shift amount in proportion to the total current value of the 1 image. The third shift calculator 222 may further increase the IR drop amount in the second region that is relatively far from the entry part of the high-potential pixel voltage ELVDD than in the first region that is relatively close to the entry part of the high-potential pixel voltage ELVDD.

The third profile shifter 223 may download the ELVDD reference profile PF1 and the MDATA reference profile PF2 from the memory 30 and may receive the shift ratio of the MDATA reference profile and the reference profile shift amount from the third shift calculator 222.

As shown in FIG. 25, the third profile shifter 223 may primarily shift the MDATA reference profile PF2 to reduce a difference between the Max data section upper limit and the Max data section lower limit in each APL section depending on the shift ratio of the MDATA reference profile and may then secondarily shift the primarily shifted MDATA reference profile to increase brightness in each APL section depending on the reference profile shift amount, and may shift the ELVDD reference profile PF1 to increase brightness in each APL section depending on the reference profile shift amount (S256).

The third profile shifter 223 may fix the Max data section upper limit in each APL section, may primarily shift the Max data section lower limit in each APL section depending on the shift ratio of the MDATA reference profile in a direction in which data is increased, may then fix the form of the primarily shifted MDATA reference profile and the ELVDD reference profile, and may further shift the primarily shifted MDATA reference profile and the ELVDD reference profile depending on the reference profile shift amount in a direction in which an APL is increased.

The third profile shifter 223 may fix the form of the primarily shifted MDATA reference profile and the ELVDD reference profile, may further shift the primarily shifted MDATA reference profile and the ELVDD reference profile depending on the reference profile shift amount in a direction in which the APL is increased, may shift the primarily shifted MDATA reference profile and the ELVDD reference profile in the first region of the image by as much as the first APL section in the direction in which the APL is increased, and may further shift the primarily shifted MDATA reference profile and the ELVDD reference profile in the second region of the image by as much as a second APL region larger than the first APL section in the direction in which the APL is increased. Here, the second region may be relatively far from the entry part of the high-potential pixel voltage compared with the first region.

The third brightness determiner 224 may receive the shifted ELVDD reference profile and the shifted MDATA reference profile from the third profile shifter 223. As shown in FIG. 25, the third brightness determiner 224 may derive the EVDD adjusting value AD1 mapped to the first APL section from the shifted ELVDD reference profile and may derive the max adjusting value AD2 mapped to the first APL from the shifted MDATA reference profile (S257). The third brightness determiner 224 may receive the non-shifted ELVDD reference profile PF1 and the non-shifted MDATA reference profile PF2 from the third profile shifter 223, and in this case, may derive the EVDD adjusting value AD1 mapped to the first APL section from the ELVDD reference profile PF1 and may derive the max adjusting value AD2 mapped to the first APL from the MDATA reference profile PF2 (S257).

As shown in FIG. 25, the third ELVDD output circuit 225 may output the EVDD adjusting value AD1 received from the third brightness determiner 224 to the power voltage output circuit 40 (S259).

As shown in FIG. 25, the third data output circuit 226 may receive the input image data iDATA of the current image frame from the host system 10 and may receive the max adjusting value AD2 from the third brightness determiner 224. The third data output circuit 226 may modulate the input image data iDATA of the current image frame based on the max adjusting value AD2 and may output the modulation image data jDATA to the data driver 50 (S257 and S258).

Figure 26A:
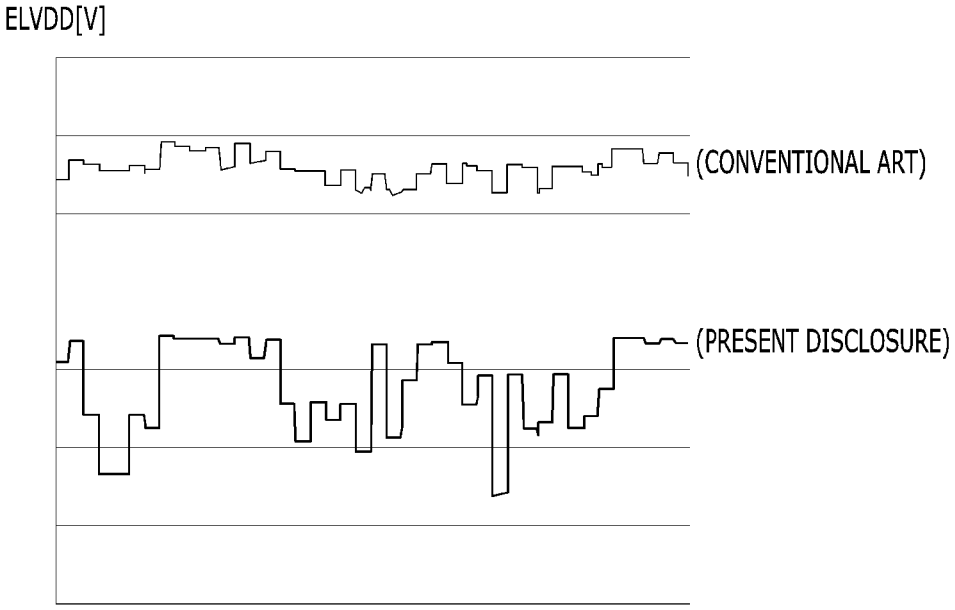
FIGS. 26A to 26C are diagrams showing simulation results for explaining a power consumption reduction effect between the conventional art and the present disclosure in which PLC driving is applied.
Figure 26B:
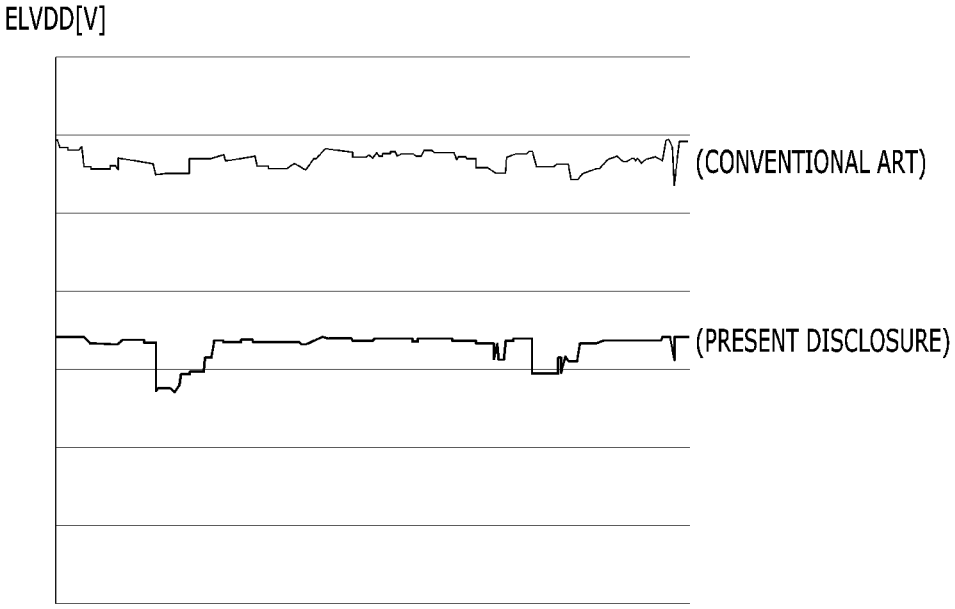
Figure 26C:
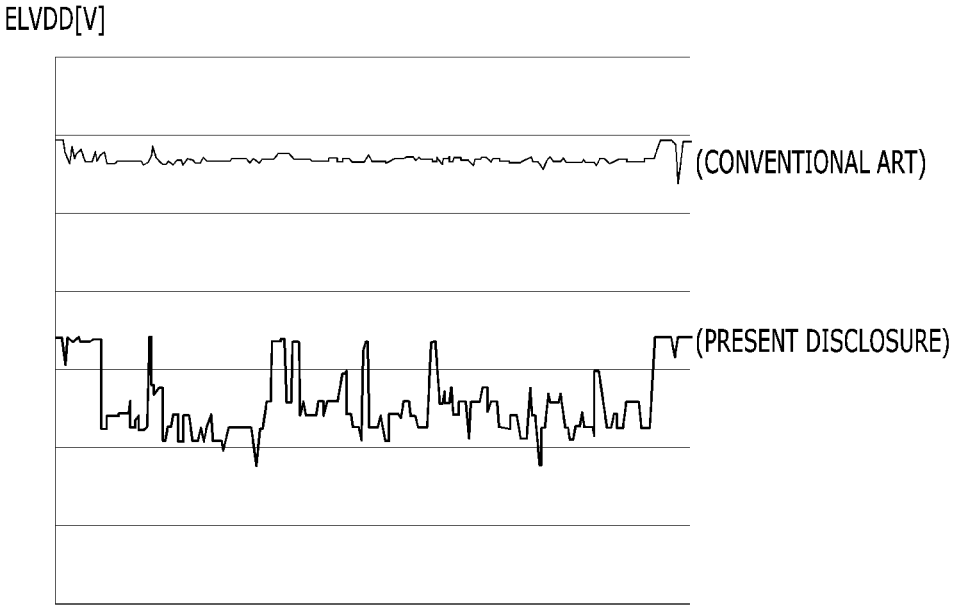

FIGS. 26A to 26C are diagrams showing simulation results for explaining a power consumption reduction effect between the conventional art and the present disclosure in which PLC driving is applied.

As described above, according to an aspect of the present disclosure, in order to match target peak brightness for each APL with a PLC curve, all of the high-potential pixel voltage ELVDD and Max data of each image may be adjusted for each APL section. According to an aspect of the present disclosure, as seen from the simultaneous results of FIGS. 26A to 26C, the high-potential pixel voltage ELVDD may be effectively lowered compared with the conventional art, thereby maximizing an effect of reducing consumption power.

According to aspects of the present disclosure, the present disclosure may have the following effects.

According to an aspect of the present disclosure, in order to match target peak brightness for each APL with a PLC curve, an electroluminescence display device may adjust all of the high-potential pixel voltage and Max data of each image for each APL section. According to an aspect of the present disclosure, the electroluminescence display device may adjust the high-potential pixel voltage and the Max data in units of APL sections, a high-potential pixel voltage may be lowered stepwise with an increase in APL, and Max data may also be lowered in the form of a ramp (or a saw tooth). As such, according to an aspect of the present disclosure, the electroluminescence display device may set a power profile to reduce the high-potential pixel voltage stepwise with an increase in APL, and thus, consumption power may be remarkably reduced when PLC driving technology is embodied. According to an aspect of the present disclosure, the electroluminescence display device may set a data profile in the form of a saw tooth to gradually reduce the Max data to the section lower limit from a section upper limit with an increase in APL in 1 APL section in which the high-potential pixel voltage is maintained constant, and thus, target peak brightness for each APL may be easily matched with a PLC curve.

In addition, according to an aspect of the present disclosure, when an APL difference between two continuous image frames is equal to or greater than a preset first threshold value, the electroluminescence display device may shift the data profile in real time to reduce a Max data difference between the two image frames (that is, section lower limits are up-shifted on a data profile), thereby preventing an issue in terms of image quality due to a Max data difference. According to an aspect of the present disclosure, the electroluminescence display device may differentially apply a shift amount of a data profile in proportion to the APL difference, thereby more effectively preventing an issue in terms of image quality due to a Max data different.

In addition, according to an aspect of the present disclosure, the electroluminescence display device may calculate total current of a panel corresponding to image data of a single image, and when the total current of the panel is equal to or greater than a preset second threshold value, the electroluminescence display device may shift the power profile and the data profile in real time to increase brightness, and in this case, may increase a shift ratio of the power profile and the data profile as a distance from an entry part of a high-potential pixel voltage is increased, thereby effectively reducing a brightness deviation due to IR drop.

The effects according to the present disclosure are not limited to the above examples, and other various effects may be included in the specification.

While the present disclosure has been particularly shown and described with reference to exemplary aspects thereof, it will be understood by those of ordinary skill in the art that various changes in form and details may be made therein without departing from the spirit and scope of the present disclosure as defined by the following claims.

What is claimed is:

1. An electroluminescence display device for lowering peak brightness of a screen image based on a preset peak luminance control (PLC) curve as an average picture level (APL) of the screen image is increased, comprising:

a memory configured to store an ELVDD reference profile for defining EVDD adjusting levels for adjusting a high-potential pixel voltage applied to pixels of the screen image in units of 1 image frame and an MDATA reference profile for defining Max data adjusting values for adjusting image data applied to the pixels of the screen image in the units of 1 image frame, for matching target peak brightness for each preset APL section with the PLC curve; and a timing controller configured to calculate an EVDD adjusting value and a Max data adjusting value of a first image frame based on an analysis result of image data of the first image frame and information stored in the memory and to modulate image data of the first image frame based on the Max data adjusting value, wherein the EVDD adjusting levels are independently defined for the each APL section, wherein the Max data adjusting values are independently defined for the each APL section, wherein the EVDD adjusting levels are lowered with increase in the APL of the screen image, and wherein the Max data adjusting values are lowered to a Max data section lower limit from a Max data section upper limit with increase in the APL in one APL section in which an EVDD adjusting level is maintained constant.

2. The electroluminescence display device of claim 1, wherein the EVDD adjusting levels are lowered stepwise with increase in the APL of the screen image.

3. The electroluminescence display device of claim 2, wherein the EVDD adjusting levels and the Max data adjusting values are changed for each of the APL sections, and the Max data adjusting values are lowered in the form of a diagonal line to the Max data section lower limit from the Max data section upper limit with increase in the APL in one APL section.

4. The electroluminescence display device of claim 2, further comprising:

a power voltage output circuit configured to generate a high-potential pixel voltage of the first image frame and to apply the high-potential pixel voltage to the pixels of the screen image with reference to the EVDD adjusting value; and a data driver configured to convert modulation image data of the first image frame into a data voltage and to then apply the data voltage to the pixels of the screen image.

5. The electroluminescence display device of claim 2, wherein the Max data adjusting values of the MDATA reference profile are changed at boundary portions of adjacent APL sections and are embodied in the form of a saw tooth.

6. The electroluminescence display device of claim 5, wherein the Max data section upper limits of the APL sections are the same in the APL sections and the Max data section lower limits of the APL sections are gradually lowered with increase in the APL.

7. The electroluminescence display device of claim 2, wherein the timing controller incudes:

a first section calculator configured to calculate a first APL of image data of the first image frame and to calculate a first APL section to which the first APL belongs;

a first shift calculator configured to compare the first APL section with a second APL section pre-calculated from a second image frame before the first image frame, and to calculate a shift ratio of the MDATA reference profile according to a comparison result;

a first profile shifter configured to download the ELVDD reference profile and the MDATA reference profile from the memory and to generate a shifted MDATA reference profile by shifting the MDATA reference profile to reduce a difference between the Max data section upper limit and the Max data section lower limit in each APL section according to the shift ratio of the MDATA reference profile;

a first brightness determiner configured to derive the EVDD adjusting value mapped to the first APL section from the ELVDD reference profile and to derive a Max data adjusting value mapped to the first APL from the shifted MDATA reference profile; and a first data output circuit configured to modulate image data of the first image frame based on the Max data adjusting value and to output the modulated image data.

8. The electroluminescence display device of claim 7, wherein, when an APL section difference value that is a comparison result between the first APL section and the second APL section is equal to or greater than a preset first threshold value, the first shift calculator calculates the shift ratio of the MDATA reference profile to be greater than 0%.

9. The electroluminescence display device of claim 8, wherein, in a condition in which the APL section difference value is equal to or greater than the first threshold value, the first shift calculator increases the shift ratio of the MDATA reference profile in proportion to the APL section difference value.

10. The electroluminescence display device of claim 9, wherein the first profile shifter fixes the Max data section upper limit in each of the APL sections and shifts the Max data section lower limit in each of the APL sections according to the shift ratio of the MDATA reference profile in a direction in which data is increased.

11. The electroluminescence display device of claim 2, wherein the timing controller includes:

a second section calculator configured to calculate a first APL of the image data of the first image frame and to calculate a first APL section to which the first APL belongs;

a second shift calculator configured to calculate a total current value of 1 image, which flows in the pixels of the screen image, according to the image data of the first image frame, and to calculate a reference profile shift amount of the MDATA reference profile and the ELVDD reference profile according to the total current value of the 1 image;

a second profile shifter configured to download the ELVDD reference profile and the MDATA reference profile from the memory, to shift the MDATA reference profile and to also shift the ELVDD reference profile to increase brightness in each APL section depending on the reference profile shift amount, and to generate the shifted ELVDD reference profile and the shifted MDATA reference profile;

a second brightness determiner configured to derive an EVDD adjusting value mapped to the first APL section from the shifted ELVDD reference profile, and to derive a Max data adjusting value mapped to the first APL from the shifted MDATA reference profile; and a second data output circuit configured to modulate image data of the first image frame based on the Max data adjusting value and to output the modulated image data.

12. The electroluminescence display device of claim 11, wherein, when the total current value of the 1 image is equal to or greater than a preset second threshold value, the second shift calculator calculates the reference profile shift amount to be equal to or greater than at least 1 APL section.

13. The electroluminescence display device of claim 12, wherein, in a condition in which the total current value of the 1 image is equal to or greater than a preset second threshold value, the second shift calculator increases the reference profile shift amount in proportion to the total current value of the 1 image.

14. The electroluminescence display device of claim 13, wherein the second profile shifter fixes a form of the MDATA reference profile and the ELVDD reference profile, and shifts the MDATA reference profile and the ELVDD reference profile depending on the reference profile shift amount in a direction in which an APL is increased.

15. The electroluminescence display device of claim 13, wherein the second shift calculator further increases the reference profile shift amount in a second region that is relatively far from an entry part of the high-potential pixel voltage than in a first region that is relatively close to the entry of the high-potential pixel voltage in a screen where the screen image is implemented.

16. The electroluminescence display device of claim 15, wherein the second profile shifter fixes a form of the MDATA reference profile and the ELVDD reference profile and shifts the MDATA reference profile and the ELVDD reference profile depending on the reference profile shift amount in a direction in which an APL is increased, and wherein the second profile shifter shifts the MDATA reference profile and the ELVDD reference profile in response to the first region by as much as the first APL section in the direction in which the APL is increased, and shifts the MDATA reference profile and the ELVDD reference profile in response to the second region by as much as the second APL section larger than the first APL section in the direction in which the APL is increased.

17. The electroluminescence display device of claim 16, wherein pixels of the first region are connected to the entry part of the high-potential pixel voltage through a first EVDD supply line, pixels of the second region are connected to the entry part of the high-potential pixel voltage through a second EVDD supply line, and the first EVDD supply line and the second EVDD supply line are electrically separated from each other.

18. The electroluminescence display device of claim 2, wherein the timing controller includes:

a third section calculator configured to calculate a first APL of the image data of the first image frame and to calculate a first APL section to which the first APL belongs;

a third shift calculator configured to compare the first APL section with the second APL section pre-calculated from a second image frame before the first image frame, to calculate a shift ratio of the MDATA reference profile according to a comparison result, to also calculate total current of 1 image, which flows in the pixels of the screen image depending on the image data of the first image frame, and to calculate a reference profile shift amount of the MDATA reference profile and the ELVDD reference profile depending on the total current of 1 image;

a third profile shifter configured to download the ELVDD reference profile and the MDATA reference profile from the memory, to primarily shift the MDATA reference profile to reduce a difference between the Max data section upper limit and the Max data section lower limit in each APL section according to a shift ratio of the MDATA reference profile and to generate the primarily shifted MDATA reference profile, to then secondarily shift the primarily shifted MDATA reference profile to increase brightness in each APL section according to the reference profile shift amount and to generate the secondarily shifted MDATA reference profile, and to also shift the ELVDD reference profile to increase brightness in each APL section according to the reference profile shift amount and to generate the shifted ELVDD reference profile;

a third brightness determiner configured to derive an EVDD adjusting value mapped to the first APL section from the shifted ELVDD reference profile, and to derive the Max data adjusting value mapped to the first APL from the secondarily shifted MDATA reference profile; and a third data output circuit configured to modulate the image data of the first image frame based on the Max data adjusting value and to output the modulated image data.

19. The electroluminescence display device of claim 18, wherein the third profile shifter fixes the Max data section upper limit in each of the APL sections, primarily shifts the Max data section lower limit in each of the APL section depending on a shift ratio of the MDATA reference profile in the direction in which data is increased and generates the primarily shifted MDATA reference profile, and then, fixes the primarily shifted MDATA reference profile and the ELVDD reference profile and further shifts the primarily shifted MDATA reference profile and the ELVDD reference profile depending on the reference profile shift amount in the direction in which the APL is increased.

20. The electroluminescence display device of claim 19, wherein the third profile shifter fixes a form of the primarily shifted MDATA reference profile and the ELVDD reference profile, further shifts the primarily shifted MDATA reference profile and the ELVDD reference profile depending on the reference profile shift amount in the direction in which the APL is increased, and wherein the third profile shifter shifts the primarily shifted MDATA reference profile and the ELVDD reference profile in a first region of the image in the direction, in which the APL is increased, by as much as the first APL section, further shifts the primarily MDATA reference profile and the ELVDD reference profile in a second region of the image, in the direction in which the APL is increased, by as much as the second APL section larger than the first APL section; and wherein the second region is relatively far from the entry part of the high-potential pixel voltage compared with the first region.

21. A method of driving an electroluminescence display device for lowering peak brightness of a screen image based on a preset peak luminance control (PLC) curve as an average picture level (APL) of the image is increased, the method comprising:

analyzing image data of a first image frame;

reading an ELVDD reference profile for defining EVDD adjusting levels for adjusting a high-potential pixel voltage applied to pixels of the screen image in units of 1 image frame and an MDATA reference profile for defining Max data adjusting levels for adjusting image data applied to the pixels of the screen image in the units of 1 image frame, from a memory, for matching target peak brightness for each preset APL section with the PLC curve; and calculating an EVDD adjusting value and a Max data adjusting value of a first image frame based on an analysis result of image data of the first image frame and information read from the memory, and modulating image data of the first image frame based on the Max data adjusting value, wherein the EVDD adjusting levels are independently defined for the each APL section, wherein the Max data adjusting values are independently defined for the each APL section, wherein the EVDD adjusting levels are lowered with increase in the APL of the screen image, and wherein the Max data adjusting values are lowered to a Max data section lower limit from a Max data section upper limit with increase in the APL in one APL section in which an EVDD adjusting level is maintained constant.

22. The method of claim 21, wherein the EVDD adjusting levels are lowered stepwise with increase in the APL of the screen image.

23. The method of claim 22, wherein the EVDD adjusting levels and the Max data adjusting values are changed for each of the APL sections, and the Max data adjusting values are lowered in the form of a diagonal line to the Max data section lower limit from the Max data section upper limit with increase in the APL in one APL section.

24. The method of claim 23, wherein the Max data adjusting values of the MDATA reference profile are relatively rapidly changed at boundary portions of adjacent APL sections and are embodied in the form of a saw tooth.

25. The method of claim 24, wherein the Max data section upper limits of the APL sections are the same in the APL sections and the Max data section lower limits of the APL sections are gradually lowered with increase in the APL.

* * * * *